US009881758B2

(12) United States Patent
Uruma et al.

(10) Patent No.: US 9,881,758 B2
(45) Date of Patent: Jan. 30, 2018

(54) CONTACT DEVICE AND ELECTROMAGNETIC RELAY EQUIPPED WITH THE CONTACT DEVICE

(71) Applicant: Panasonic Intellectual Property Management Co., Ltd., Osaka (JP)

(72) Inventors: Katsuya Uruma, Aichi (JP); Hideki Enomoto, Nara (JP); Yohji Ikeda, Hokkaido (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/412,946

(22) PCT Filed: Jul. 1, 2013

(86) PCT No.: PCT/JP2013/004068

§ 371 (c)(1),
(2) Date: Jan. 5, 2015

(87) PCT Pub. No.: WO2014/006871

PCT Pub. Date: Jan. 9, 2014

(65) Prior Publication Data

US 2015/0194284 A1 Jul. 9, 2015

(30) Foreign Application Priority Data

Jul. 6, 2012 (JP) ..... 2012-152663

(51) Int. Cl.
*H01H 63/02* (2006.01)
*H01H 50/64* (2006.01)
(Continued)

(52) U.S. Cl.
CPC ..... *H01H 50/64* (2013.01); *H01H 1/06* (2013.01); *H01H 9/443* (2013.01);
(Continued)

(58) Field of Classification Search
CPC ..... H01H 51/22; H01H 47/00; H01H 47/06; H01H 50/20; H01H 50/22; H01H 50/022; H01H 50/443; H01H 50/546
(Continued)

(56) References Cited

U.S. PATENT DOCUMENTS 3,271,707 A * 9/1966 Koehler ..... H01H 50/643 335/106
3,601,727 A * 8/1971 Hults ..... H01H 13/506 200/404

(Continued)

FOREIGN PATENT DOCUMENTS

FR 2523764 A1 9/1983
JP 60-53144 U 4/1985

(Continued)

OTHER PUBLICATIONS

International Search Report issued in International Application No. PCT/JP2013/004068 dated Jul. 30, 2013 with English translation.

(Continued)

*Primary Examiner* — Shawki S Ismail
*Assistant Examiner* — Lisa Homza
(74) *Attorney, Agent, or Firm* — McDermott Will & Emery LLP

(57) ABSTRACT

A contact device includes: a contact block including a plurality of fixed terminals on which fixed contacts are formed, and a movable contactor on which movable contacts contacting and leaving the fixed contacts are formed; and a driving block that drives the movable contactor. Moreover, it is made possible to extinguish arcs, which are generated in an event where the contacts contact and leave each other, by arranging permanent magnets on a periphery of the contact block. Then, at least one fixed terminal among the plurality of fixed terminals is formed so that the fixed contact (Continued)

and the movable contact can abut against each other in a region other than a side opposite to the other fixed terminal.

11 Claims, 15 Drawing Sheets

(51) Int. Cl.
*H01H 9/44* (2006.01)
*H01H 50/54* (2006.01)
*H01H 1/06* (2006.01)
*H01H 1/20* (2006.01)
*H01H 50/02* (2006.01)

(52) U.S. Cl.
CPC ..... *H01H 50/546* (2013.01); *H01H 1/2083* (2013.01); *H01H 2050/025* (2013.01); *H01H 2201/022* (2013.01)

(58) Field of Classification Search
USPC ..... 335/133
See application file for complete search history.

(56) References Cited

U.S. PATENT DOCUMENTS 5,394,128 A * 2/1995 Perreira ..... H01H 33/66 335/126
5,631,613 A * 5/1997 Niimi ..... H01H 51/065 335/126
5,757,255 A * 5/1998 Noda ..... H01H 50/642 335/129
5,892,194 A * 4/1999 Uotome ..... H01H 1/34 218/68
6,700,466 B1 * 3/2004 Yamamoto ..... H01H 9/302 218/156
6,911,884 B2 * 6/2005 Uotome ..... H01H 47/06 335/132
7,157,995 B2 * 1/2007 Nishida ..... H01H 50/36 335/126
7,852,178 B2 * 12/2010 Bush ..... H01H 51/2209 335/126
7,876,183 B2 * 1/2011 Uruma ..... H01H 50/04 335/126
7,911,301 B2 * 3/2011 Yano ..... H01H 9/443 335/131
8,138,872 B2 * 3/2012 Yoshihara ..... H01F 7/1615 335/124
8,198,964 B2 * 6/2012 Yoshihara ..... H01H 51/29 335/131
8,274,345 B2 * 9/2012 Sugisawa ..... H01H 50/54 335/126
8,395,463 B2 * 3/2013 Ito ..... H01H 9/34 335/202
8,492,916 B2 * 7/2013 Murata ..... F02N 11/087 290/38 R
8,642,906 B2 * 2/2014 Yeon ..... H01H 50/023 200/430
9,076,620 B2 * 7/2015 Lee ..... H01H 50/305
9,196,442 B2 * 11/2015 Ito ..... H01H 50/54
9,324,524 B2 * 4/2016 Kawaguchi ..... H01H 50/20
9,431,200 B2 * 8/2016 Choi ..... H01H 51/065
9,496,109 B2 * 11/2016 Lee ..... H01H 50/10
2004/0027776 A1 * 2/2004 Uotome ..... H01H 47/06 361/160
2004/0080389 A1 * 4/2004 Nishida ..... H01H 50/026 335/132
2005/0030136 A1 * 2/2005 Babich ..... H01F 3/02 335/220
2006/0050466 A1 * 3/2006 Enomoto ..... H01H 50/02 361/160
2007/0241847 A1 * 10/2007 Yamamoto ..... H01H 50/305 335/196
2009/0066450 A1 * 3/2009 Yano ..... H01H 49/00 335/203
2009/0096559 A1 4/2009 Yano et al.
2009/0322453 A1 * 12/2009 Kawaguchi ..... H01F 7/1615 335/81
2009/0322454 A1 * 12/2009 Tanaka ..... H01H 1/54 335/189
2010/0060392 A1 * 3/2010 Cho ..... H01H 50/023 335/124
2010/0066471 A1 * 3/2010 Nagura ..... H01H 9/047 335/201
2011/0032059 A1 * 2/2011 Ito ..... H01H 9/34 335/202
2012/0091941 A1 4/2012 Hong
2013/0012037 A1 1/2013 Enomoto et al.
2013/0057369 A1 * 3/2013 Yano ..... H01H 1/66 335/156
2013/0099880 A1 4/2013 Yano et al.
2013/0127571 A1 * 5/2013 Takaya ..... H01H 9/443 335/201
2013/0214882 A1 * 8/2013 Ito ..... H01H 1/20 335/151
2013/0234811 A1 * 9/2013 Nishimura ..... H01H 50/643 335/189

FOREIGN PATENT DOCUMENTS

JP 61-51643 U 4/1986
JP 2002-334644 A 11/2002
JP 2011-204478 A 10/2011
JP 2012-089493 A 5/2012
WO 2011/115056 A1 9/2011

OTHER PUBLICATIONS

European Search Report dated Jun. 19, 2015 issued in European Patent Application No. 13812568.7.

* cited by examiner

CONTACT DEVICE AND ELECTROMAGNETIC RELAY EQUIPPED WITH THE CONTACT DEVICE

RELATED APPLICATIONS

This application is the U.S. National Phase under 35 U.S.C. § 371 of International Application No. PCT/JP2013/004068, filed on Jul. 1, 2013, which in turn claims the benefit of Japanese Application No. 2012-152663, filed on Jul. 6, 2012, the disclosures of which Applications are incorporated by reference herein.

TECHNICAL FIELD

The present invention relates to a contact device and an electromagnetic relay equipped with the contact device.

BACKGROUND ART

Heretofore, as a contact device, one has been known, which includes: a contact block including a plurality of fixed terminals provided with fixed contacts, and including a movable contactor provided with movable contacts which contact and leave the fixed contacts; and a driving block that drives the movable contactor (for example, refer to Patent Literature 1).

In this Patent Literature 1, permanent magnets are arranged in the vicinity of the contact block, and arcs generated in an event where the contacts contact and leave each other are extended to outsides of the contacts by force of the permanent magnets, thus making it possible to extinguish the generated arcs. Here, each of the outsides of the contacts stands for a direction other than an inside of each pair of the contacts, that is, a direction other than a side opposite to other fixed terminal, the side being of the fixed terminal having the fixed contact in which the arc is generated at a contact portion.

CITATION LIST

Patent Literature

Patent Literature 1: Japanese Patent Application Publication No. 2011-204478

SUMMARY OF INVENTION

Technical Problem

However, when the contact device is configured to extend the arcs, which are generated in the event where the contacts contact and leave each other, to the outsides by the force of the permanent magnets as in the above-described conventional technology, then it is apprehended that it may take longer to extend the arcs to the outsides in a case where the arcs are generated in the insides of the contacts. If it takes long to extend the arcs to the outsides as described above, then it is apprehend that an arc cutoff time may become long, and that arc cutoff performance of the contact device may be lowered.

In this connection, it is an object of the present invention to obtain a contact device capable of suppressing the arc cutoff performance from being lowered, and to obtain an electromagnetic relay equipped with the contact device.

Solution to Problem

A first feature of the present invention is a contact device including: a contact block having a plurality of fixed terminals on which fixed contacts are formed, and a movable contactor on which movable contacts contacting and leaving the fixed contacts are formed; a driving block that drives the movable contactor on that the movable contacts can contact and leave the fixed contacts; and a magnetic field forming unit that is arranged on a periphery of the contact block and forms a magnetic field, wherein, in at least one fixed terminal among the plurality of fixed terminals, the fixed contact and the movable contact abut against each other in a region other than a side opposite to other fixed terminal.

A second feature of the present invention is that the magnetic field forming unit includes a pair of permanent magnets arranged opposite to each other through the contact block in a direction perpendicular to a contacting/leaving direction of the movable contacts and the fixed contacts, and polarities of surfaces of the pair of permanent magnets, the surfaces being opposite to each other, are the same.

A third feature of the present invention is that a magnetic material is provided on the movable contactor.

A fourth feature of the present invention is that, in the one fixed terminal, the fixed contact and the movable contact are allowed to abut against each other in the region other than the side opposite to the other fixed terminal by forming a step difference portion on at least one side of a fixed terminal side and a movable contactor side.

A fifth feature of the present invention is that the step difference portion is formed on the movable contactor side.

A sixth feature of the present invention is that the movable contactor is driven by a driving shaft of the driving block, and the step difference portion is formed to have a circular arc shape taking the driving shaft of the movable contactor as a substantial center when viewed from the above.

A seventh feature of the present invention is that the step difference portion is formed on the fixed contact side.

An eighth feature of the present invention is that the step difference portion is formed over an entire circumference of the fixed terminal side.

A ninth feature of the present invention is that the step difference portion is formed so that a step difference surface that couples step differences to each other can extend in the contacting/leaving direction of the movable contacts and the fixed contacts.

A tenth feature of the present invention is that an electromagnetic relay is equipped with the above-described contact device.

Advantageous Effects of Invention

According to the present invention, in the at least one fixed terminal among the plurality of fixed terminals, the movable contact is allowed to abut against the fixed contact of the at least one fixed terminal in the region other than the side opposite to the other fixed terminal in the event where the movable contact abuts against the fixed contact. Therefore, such an arc can be suppressed from being generated in the inside of the contacts in the event where the contacts contact and leave each other. As a result, it becomes possible to suppress the arc cutoff performance of the contact device from being lowered.

BRIEF DESCRIPTION OF DRAWINGS

FIG. 1(*a*) is a side view; and FIG. 1(*b*) is a side view viewed from a direction perpendicular to FIG. 1(*a*).

FIG. 2(*a*) is a side cross-sectional view; and FIG. 2(*b*) is a side cross-sectional view cut in a direction perpendicular to FIG. 2(*a*).

DESCRIPTION OF EMBODIMENTS

Figure 1:
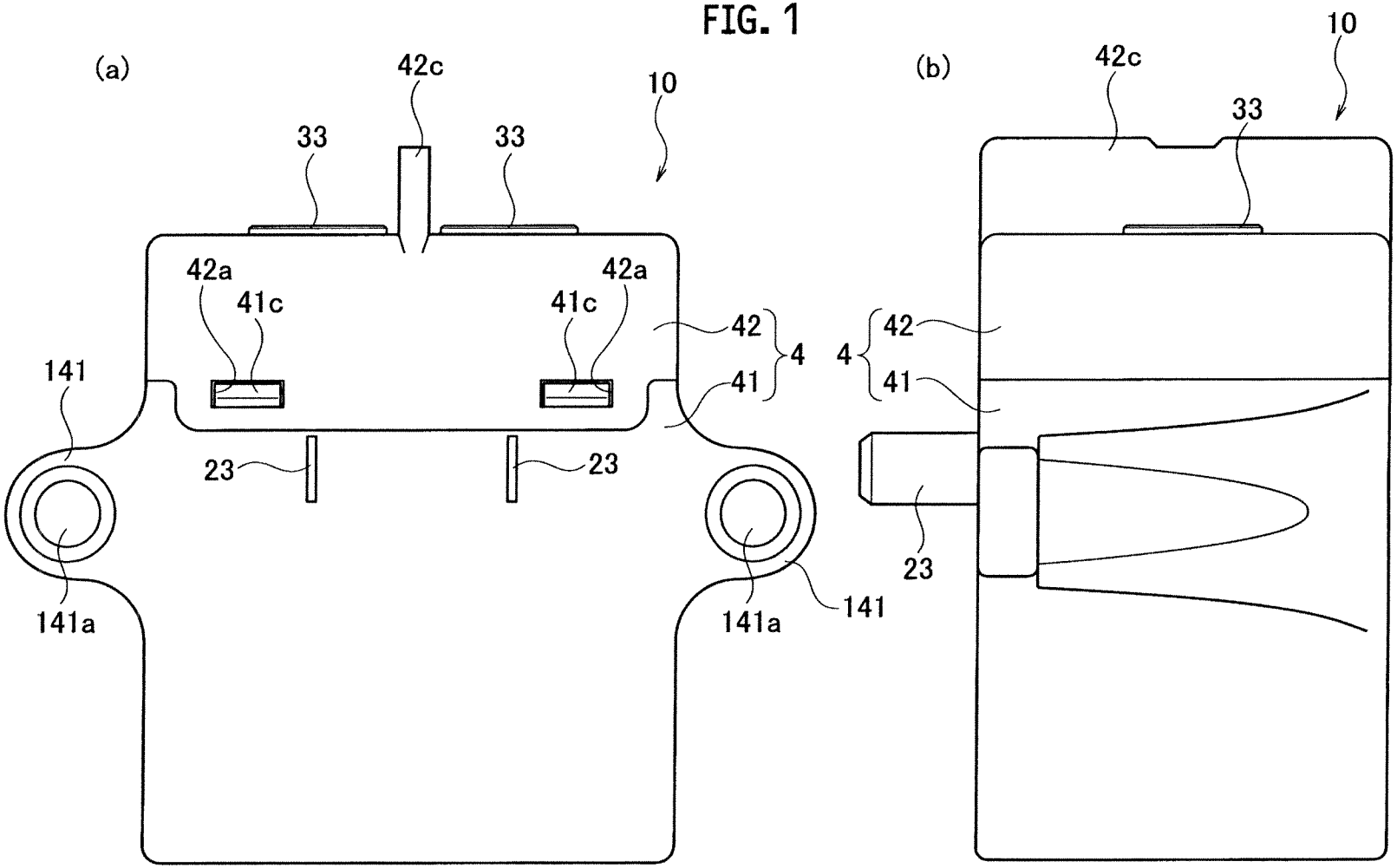
FIGS. 1(*a*) and 1(*b*) are views showing a contact device according to a first embodiment of the present invention.

A description is made below in detail of embodiments of the present invention while referring to the drawings. Those are exemplified below, in each of which an electromagnetic relay is equipped with a contact device. Then, the description is made on the definition that a movement direction of a movable contactor is an up-and-down direction, that an array direction of a fixed contactor is a right-and-left direction, and that a direction perpendicular to the up-and-down direction and the right-and-left direction is a back-and-forth direction. Moreover, the description is made on the definition that an upper side in a state of FIG. 1(*a*) and FIG. 2(*a*) is an upper side in the up-and-down direction, and that a right side therein is a right side in the right-and-left direction, and that a right side in a state of FIG. 1(*b*) and FIG. 2(*b*) is a front side in the back-and-forth direction.

Moreover, an inside of each of contacts is defined as a side opposite to other fixed terminal, the side being of a fixed terminal having a fixed contact in which an arc is generated at a contact portion, and an outside of each of the contacts is defined as a direction other than the inside of the contact.

Furthermore, similar constituents are included in a plurality of the following embodiments and modification examples thereof. Hence, in the following, common reference numerals are assigned to those similar constituents, and in addition, a redundant description thereof is omitted.

(First Embodiment)

Figure 3:
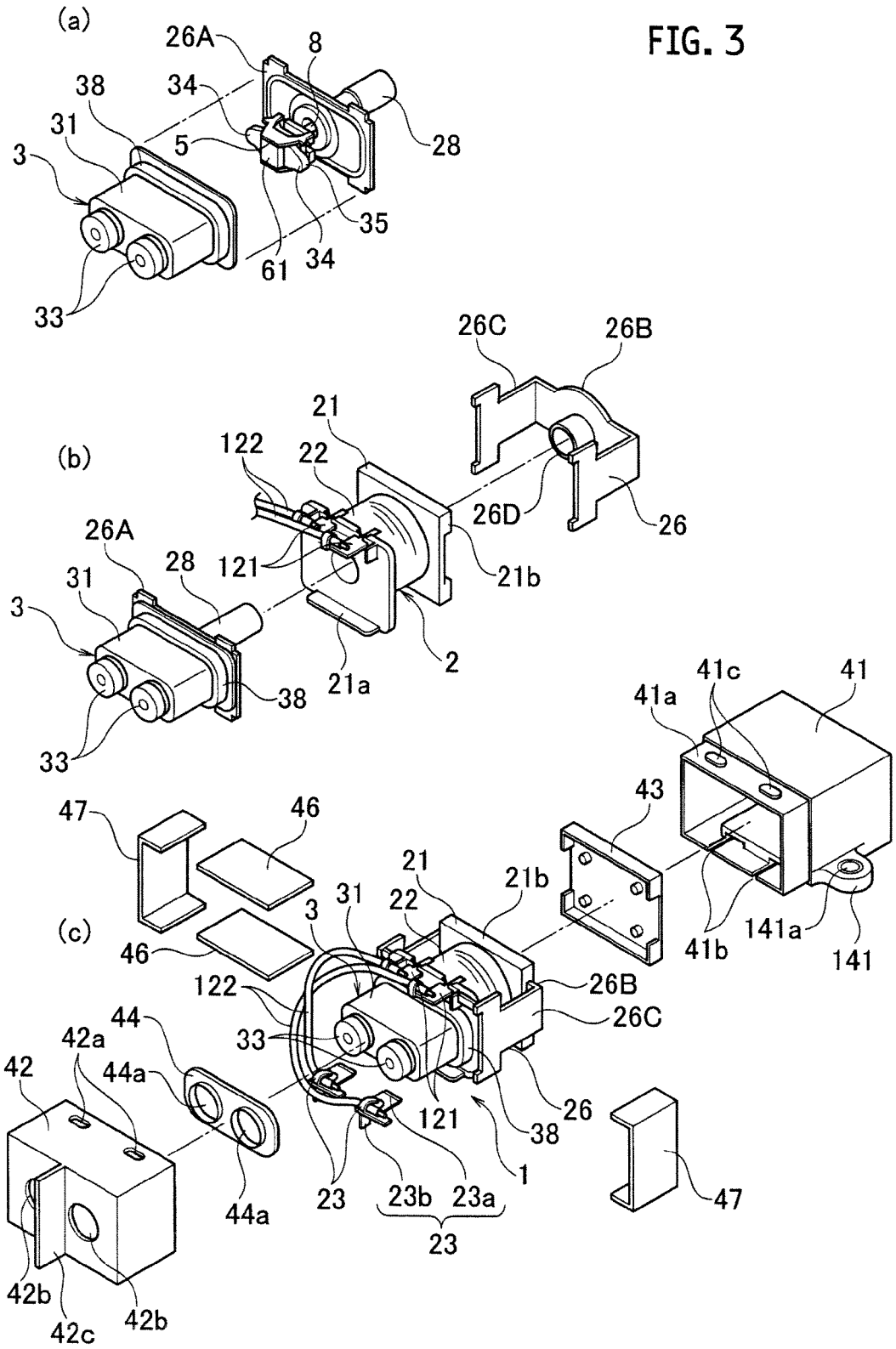
FIGS. 3(*a*) to 3(*c*) are exploded perspective views sequentially explaining an assembly method of the contact device according to the first embodiment of the present invention.

As shown in FIGS. 1(*a*) and 1(*b*) to FIGS. 3(*a*) to 3(*c*), a contact device 10 according to this embodiment is formed in such a manner that an internal instrument block 1, which is composed by combining an electromagnet block 2 (driving block) and a contact block 3 integrally with each other, is housed in a hollow box-like housing 4.

The electromagnet block 2 includes: a hollow cylindrical coil bobbin 21 around which an excitation winding 22 is wound; a pair of coil terminals 23 to which both ends of the excitation winding 22 are individually connected; and a fixed iron core 24 fixed to a cylinder of the coil bobbin 21 and is magnetized by the energized excitation winding 22. Moreover, the electromagnet block 2 includes: a movable iron core 25 arranged opposite to the fixed iron core 24 in the cylinder of the coil bobbin 21 in an axial direction (up-and-down direction) of the coil bobbin 21; and a yoke 26 that is made of a magnetic material and surrounds the coil bobbin 21. Furthermore, the electromagnet block 2 includes a return spring 27 that is arranged in the cylinder of the coil bobbin 21 and urges the movable iron core 25 downward.

The coil bobbin 21 is made of resin that is an insulating material, and is formed into a substantially cylindrical shape having brim portions 21*a* and 21*b* on upper and lower ends thereof. Then, the excitation winding 22 is wound around a cylinder portion 21*c* between the brim portions 21*a* and 21*b*. In this embodiment, this cylinder portion 21*c* is formed so that an inner diameter on a lower end side thereof can be larger than an inner diameter on an upper end side thereof.

As shown in FIGS. 3(*b*) and 3(*c*), end portions of the excitation winding 22 are individually connected to a pair of terminal portions 121 provided on the brim portion 21*a* of the coil bobbin 21, and are individually connected to the pair of coil terminals 23 through lead wires 122 connected to the terminal portions 121.

The coil terminals 23 are made of a conductive material such copper, and are connected to the lead wires 122 by solder and the like.

The movable iron core 25 is arranged inside the cylinder of the coil bobbin 21, and is made movable in the axial direction (up-and-down direction) in the cylinder of the coil bobbin 21. Then, in an event where the movable iron core 25 is attracted to the fixed iron core 24 in response to energization or de-energization of the excitation winding 22, the movable iron core 25 moves upward.

Figure 2:
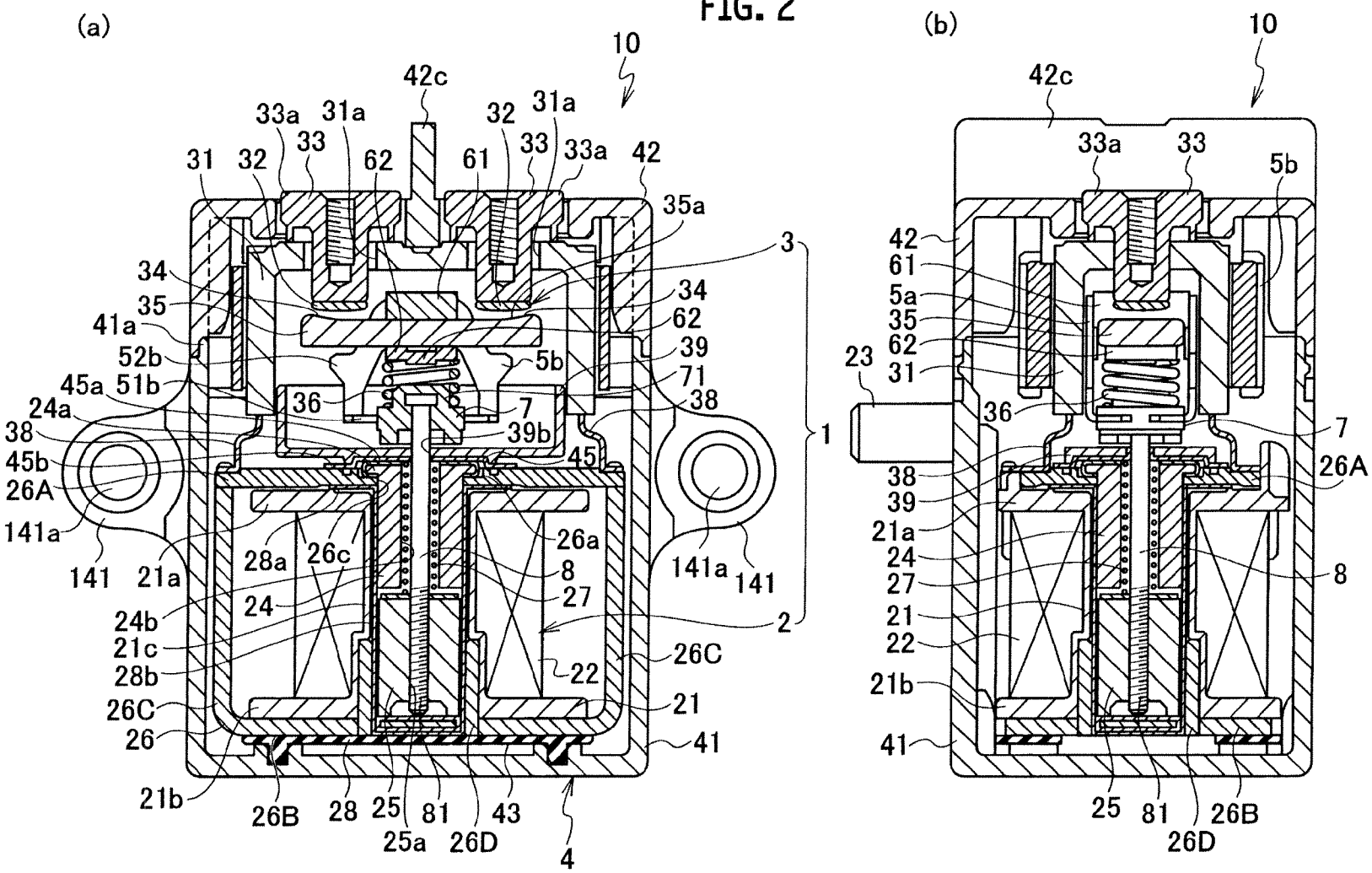
FIGS. 2(*a*) and 2(*b*) are views showing the contact device according to the first embodiment of the present invention.

As shown in FIG. 2(*a*), the yoke 26 includes: a yoke plate 26A arranged on an upper end side of the coil bobbin 21; a yoke plate 26B arranged on a lower end side of the coil bobbin 21; and a pair of yoke plates 26C arranged from both right and left sides of the yoke plate 26B to the yoke plate 26A side.

The yoke plate 26A is formed into a substantially rectangular plate shape, a recessed portion 26*a* is formed on a substantial center on an upper surface side of the yoke plate 26A, and an insertion hole 26*c* is formed on a substantial center of the recessed portion 26*a*. A cylindrical member 28 with a closed-end cylindrical shape is inserted through this insertion hole 26*c*. The cylindrical member 28 has a cylindrical portion 28*b* and a brim portion 28*a* formed on an upper end of the cylindrical portion 28*b*, and the brim portion 28*a* is to be joined to the recessed portion 26*a* in an event where the cylindrical portion 28*b* is inserted through the insertion hole 26*c*. Moreover, the movable iron core 25 formed of a magnetic material into a substantially columnar shape is arranged on a lower end side of the cylindrical portion 28*b* of the cylindrical member 28. Furthermore, inside the cylindrical portion 28*b*, the fixed iron core 24 is arranged, which is formed of a magnetic material into a substantially cylindrical shape, and is opposite to the movable iron core 25 in the axial direction.

Moreover, on an upper surface of the yoke plate 26A, a substantially disc-like cap member 45 is provided, in which a peripheral edge portion is fixed to an opening peripheral edge of the insertion hole 26*c* in the yoke plate 26A, and the movable iron core 25 is retained by the cap member 45. Moreover, in a substantial center of the cap member 45, a recessed portion 45*a* recessed upward in a substantially columnar shape is formed, and a brim portion 24*a* formed on an upper end of the fixed iron core 24 is to be housed in the recessed portion 45*a*.

Then, a cylindrical bush 26D formed of a magnetic material is fitted to a gap portion formed between an inner circumferential surface of a lower end side in the coil bobbin 21 and an outer circumferential surface of the cylindrical member 28. This bush 26D forms a magnetic circuit together with the yoke plates 26A to 26C, the fixed iron core 24 and the movable iron core 25.

The return spring 27 is inserted through a through hole 24*b* formed in the fixed iron core 24. Then, a lower end of the return spring 27 abuts against an upper surface of the movable iron core 25, and an upper end thereof abuts against a lower surface of the cap member 45. At this time, the return spring 27 is provided in a compressed state between the movable iron core 25 and the cap member 45, and the movable iron core 25 is urged downward by elastic restoration force of this return spring 27.

Meanwhile, the contact block 3 includes: a case 31; a pair (plurality) of fixed terminals 33; a movable contactor 35; a contact pressure spring 36; a holding portion 5; an adjustment plate 61; a yoke 62; a spring receiving portion 7; and a movable shaft (driving shaft) 8.

The movable shaft 8 is formed into a substantially round bar shape long in the up-and-down direction, and a screw groove is formed on a lower end side thereof, whereby a screw portion 81 is formed. Then, the lower end side of the movable shaft 8 is inserted through an insertion hole 45*b* formed in a substantial center of the recessed portion 45*a* in the cap member 45 and through the return spring 27. Then, the screw portion 81 of the movable shaft 8 is screwed to a screw hole 25*a* formed in the movable iron core 25 along the axial direction, whereby the movable shaft 8 and the movable iron core 25 are connected to each other. Moreover, an upper end of the movable shaft 8 is connected to the spring receiving portion 7.

The case 31 is made of a heat-resistant material such as ceramics into a hollow box shape in which a lower surface is opened, and two through holes 31*a* are arrayed on an upper surface thereof.

The fixed terminals 33 are made of a conductive material such as copper into a substantially columnar shape. Then, brim portions 33*a* are formed on upper ends of the fixed terminals 33, and fixed contacts 32 are provided on lower ends thereof. In this embodiment, the fixed terminals 33 are allowed to penetrate the through holes 31*a* of the case 31, and in addition, the brim portions 33*a* are brazed to the case 31 in a state of being protruded from the upper surface of the case 31, whereby the fixed terminals 33 are joined to the case 31. Note that the fixed contacts 32 may be formed integrally with the fixed terminals 33.

Moreover, as shown in FIG. 2(*a*), one end of a flange 38 is joined to an opening peripheral edge of the case 31 by brazing. Then, another end of the flange 38 is joined to the first yoke plate 26A by brazing.

Furthermore, on an opening portion of the case 31, there is provided an insulating member 39 for insulating arcs, which are generated between the fixed contacts 32 and movable contacts 34, from a joint portion between the case 31 and the flange 38.

The insulating member 39 is made of an insulating material such as ceramics and synthetic resin into a substantially hollow rectangular parallelepiped shape in which an upper surface is opened, and allows an upper end side of a peripheral wall thereof to abut against an inner surface of a peripheral wall of the case 31. In this way, a contact portion, which is composed of the fixed contacts 32 and the movable contacts 34, and the joint portion between the case 31 and the flange portion 38, are insulated from each other.

Furthermore, in a substantial center of an inner bottom surface of the insulating member 39, an insertion hole 39*b* for inserting the movable shaft 8 is formed.

The movable contactor 35 is formed into a flat plate shape, which is long in the right-and-left direction, and the movable contacts 34 are formed on both right and left end sides of an upper surface thereof. In this embodiment, the movable contacts 34 are formed integrally with the movable contactor 35; however, the movable contacts 34 may be provided separately from the movable contactor 35. Then, the movable contactor 35 is arranged so that the movable contacts 34 can be arranged opposite to the fixed contacts 32 at a predetermined interval. Moreover, the yoke (magnetic material) 62 is provided on a substantial center portion of the movable contactor 35 in the right-and-left direction.

The yoke 62 is made of a magnetic material, and is formed into a substantially U-shape in cross section in which an upper portion is opened. Then, the yoke 62 is provided so as to sandwich a center portion in the right-and-left direction of the movable contactor 35 from the back-and-forth direction. Moreover, the yoke 62 is arranged below the movable contactor 35. Furthermore, a positioning protrusion portion 621 with a substantial disc shape is formed on a substantial center of a lower surface of the yoke 62.

The contact pressure spring 36 is composed of a coil spring, and is arranged in a state where an axial direction thereof is oriented in the up-and-down direction. Then, the positioning protrusion portion 621 is fitted to an inner diameter portion of an upper end side of the contact pressure spring 36, whereby the contact pressure spring 36 is positioned with respect to the yoke 62 and the movable contactor 35.

The spring receiving portion 7 is made of a material having electrical insulating properties, for example, such as resin into a substantially rectangular plate shape, and a substantially disc-like positioning protrusion portion 71 is formed on a substantial center of an upper surface of the spring receiving portion 7. Then, an inner diameter portion of a lower end side of the contact pressure spring 36 is fitted to the positioning protrusion portion 71, whereby the spring receiving portion 7 and the contact pressure spring 36 are positioned with respect to each other.

The adjustment plate 61 is made of a magnetic material such as pure iron (SUY) and a cold-rolled steel plate (SPCC, SPCE) into a substantially rectangular plate shape. This adjustment plate 61 is fixed to the holding portion 5, which will be described later, in a state of being mounted on an upper surface of a substantial center portion (narrow width portion 351) in the right-and-left direction of the movable contactor 35.

The holding portion 5 is made of a non-magnetic material such as stainless steel (SUS), and includes a bottom plate 51 and a pair of side plates 52. Together with the adjustment plate 61, the bottom plate 51 sandwiches the movable contactor 35, the yoke 62 and the contact pressure spring 36 in the up-and-down direction. Hence, the movable contactor 35 is pressed upward by the contact pressure spring 36, and the upper surface thereof abuts against the adjustment plate 61, whereby movement thereof to the fixed contact 32 side is regulated. The pair of side plates 52 is extended upward from a front end and rear end of the bottom plate 51 and is opposite to each other in the back-and-forth direction, a front end and rear end of the movable contactor 35 (yoke 62) are brought into slide contact therewith, and the side plates 52 concerned abuts against a front end and rear end of the adjustment plate 61, and thereby sandwich the adjustment plate 61 in the back-and-forth direction.

Figure 4:
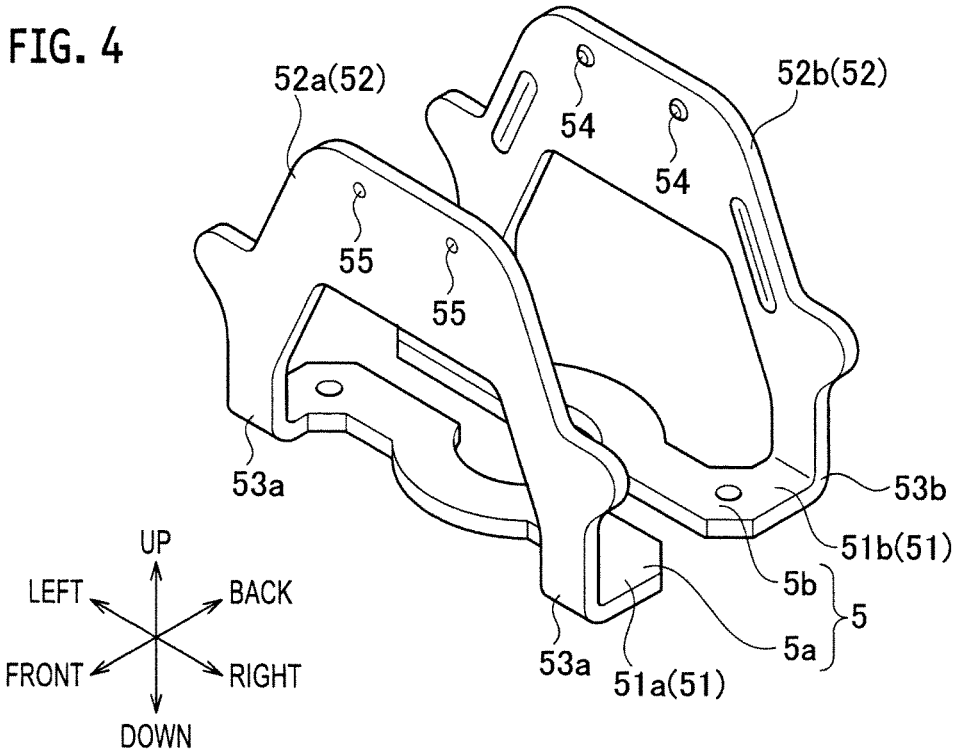
FIG. 4 is a perspective view showing a holding portion according to the first embodiment of the present invention.

Moreover, in this embodiment, as shown in FIG. 4, the bottom plate 51 is divided in the back-and-forth direction, and is composed of a first bottom plate 51*a* and a second bottom plate 51*b*. That is to say, the holding portion 5 is divided into: a first holding portion 5*a* including the first bottom plate 51*a* and a first side plate 52*a* extended from a front end of the first bottom plate 51*a*; and a second holding portion 5*b* including the second bottom plate 52*b* and a second side plate 52*b* extended from a rear end of the second bottom plate 52*b*.

In this embodiment, the first and second bottom plates 51*a* and 51*b* and the first and second side plates 52*a* and 52*b* are formed by bending a non-magnetic material with a plate frame shape. Hence, the first bottom plate 51*a* and the first side plate 52*a* continue with each other through first bent portions 53*a*, and the second bottom plate 51*b* and the second side plate 52*b* continue with each other through second bent portions 53*b*. Then, the first and second holding portions 5*a* and 5*b* are molded integrally with the spring receiving portion 7 in a state of being spaced apart from each other in the back-and-forth direction, and the spring receiving portion 7 is interposed between the bottom plate 51 (first and second bottom plates 51*a* and 51*b*) and the contact pressure spring 36. That is to say, the spring receiving portion 7 is provided on the bottom plate 51 (first and second bottom plates 51*a* and 51*b*), and electrically insulates the bottom plate 51 and the contact pressure spring 36 from each other.

As described above, in this embodiment, the holding portion 5 includes the first and second holding portions 5*a* and 5*b* obtained by dividing the same in the back-and-forth direction, and the first and second holding portions 5*a* and 5*b* are molded integrally with the spring receiving portion 7, which has the insulating properties, in the state of being spaced apart from each other. Then, the adjustment plate 61 is sandwiched by the first and second side plates 52*a* and 52*b*, whereby the first and second holding portions 5*a* and 5*b* are electrically connected to each other only through the adjustment plate 61.

Moreover, by adopting such a configuration, it is made possible to easily adjust an initial contact pressure of the contact pressure spring 36 just by adjusting a position in the up-and-down direction of the adjustment plate 61. Note that reference numerals 54 of FIG. 4 denote protruding portions for performing projection welding for the adjustment plate 61 and the holding portion 5 with each other, and reference numerals 55 denote recessed portions formed in an event of forming the protruding portions 54 by extrusion molding.

Moreover, in this embodiment, the adjustment plate 61 arranged above the movable contactor 35 and the yoke 62 arranged below the movable contactor 35 are made of a magnetic material. Then, the holding portion 5 (first and second holding portions 5*a* and 5*b*) is made of a non-magnetic material. Therefore, in an event where the fixed contacts 32 and the movable contacts 34 contact each other and a current flows through the movable contactor 35, a magnetic flux, which passes through the adjustment plate 61 and the yoke 62 while taking the movable contactor 35 as a center, is formed on the periphery of the movable contactor 35. As a result, magnetic attraction force acts between the adjustment plate 61 and the yoke 62, and by this magnetic attraction force, electromagnetic repulsion force generated between the fixed contacts 32 and the movable contacts 34 is suppressed, and a contact pressure between the fixed contacts 32 and the movable contacts 34 can be suppressed from being lowered.

As described above, in this embodiment, the adjustment plate 61 is also imparted with a function of the yoke, and this adjustment plate 61 also corresponds to the magnetic material provided on the movable contactor 35. Note that the adjustment plate 61 may be made of a non-magnetic material, a yoke (magnetic material) made of the magnetic material may be provided separately from the adjustment plate 61, and the magnetic circuit may be formed of the yoke concerned and the yoke 62.

The housing 4 is made of a resin material into a substantially rectangular box shape, and includes: a hollow box-like housing body 41 in which an upper surface is opened; and a hollow box-like cover 42 provided to cover an opening of the housing body 41.

Protruding portions 141 are provided on front ends of right and left sidewalls of the housing body 41, and in the protruding portions 141, insertion holes 141*a* are formed, which are used in an event of fixing the contact device 10 to an attachment surface by screw fastening. Moreover, a step portion 41*a* is formed on an opening peripheral edge on an upper end side of the housing body 41, and an outer periphery thereof is smaller than that on a lower end side of the housing body 41. Then, on a front surface above the step portion 41*a* in the housing body 41, there are formed a pair of slits 41*b* to which terminal portions 23*b* of the coil terminals 23 are fitted. Furthermore, on a rear surface above the step portion 41*a* in the housing body 41, a pair of protruding portions 41*c* is arrayed in the right-and-left direction.

The cover 42 is formed into a hollow box shape in which a lower surface is opened, and on a rear surface thereof, a pair of recessed portions 42*a* is formed, into which the protruding portions 41*c* of the housing body 41 are fitted in an event of assembling the cover 42 to the housing body 41. Moreover, on an upper surface of the cover 42, a partition portion 42*c* is formed, which divides the upper surface substantially into two in the right-and-left direction. On the upper surface thus divided into two by the partition portion 42*c*, a pair of insertion holes 42*b*, through which the fixed terminals 33 are inserted, is individually formed.

Then, in an event of housing the internal instrument block 1, which includes the electromagnet block 2 and the contact block 3, in the housing 4, a substantially rectangular lower cushion rubber 43 is interposed between the brim portion 21*b* on the lower end of the coil bobbin 21 and a bottom surface of the housing body 41 as shown in FIG. 3(*c*). Then, between the case 31 and the cover 42, an upper cushion rubber 44 with insertion holes 44*a* formed for inserting the brim portions 33*a* of the fixed terminals 33 is interposed.

Moreover, in the contact device 10, a magnetic blow structure including a magnetic field forming portion to form a magnetic field is formed, and it is made possible to extend and extinguish the arcs generated in the event where the contacts (fixed contacts 32 and movable contacts 34) contact and leave each other.

In this embodiment, the magnetic blow structure is formed of: a pair of permanent magnets (magnetic field forming portion) 46 arranged opposite to each other; and yokes 47 connected to the pair of permanent magnets 46.

The permanent magnets 46 are formed into a substantially rectangular parallelepiped shape, and are provided so as to extend in a longitudinal direction (right-and-left direction) of the movable contactor 35. Specifically, the pair of permanent magnets 46 is arranged opposite to each other individually on a front side and rear side of the movable contactor 35 through a gap (contact gap) between the fixed contacts 32 and the movable contacts 34. At this time, in the pair of permanent magnets 46 opposite to each other, polarities of surfaces thereof opposite to each other are the same (N pole in this embodiment). That is to say, the front permanent magnet 46 is provided so that a front surface thereof can become an S pole and that such a rear surface thereof can become an N pole, and the rear permanent magnet 46 is provided so that such a front surface thereof can become the N pole and that a rear surface thereof can become the S pole. Note that it is also possible to arrange the permanent magnets so that polarities of the surfaces opposite to each other can become the S pole, and it is also possible to arrange the permanent magnets so that the polarities of the surfaces opposite to each other can be different from each other.

The yokes 47 are formed into a substantially U-shape, of: base portions 47*a* opposite to end surfaces in a longitudinal direction of the movable contactor 35; and pairs of extended portions 47*b*, which are extended from both ends of the base portions 47*a* substantially perpendicularly to the base portions 47*a*, and are individually connected to the pair of permanent magnets 46. Here, the pairs of extended portions 47*b* are connected to the S-pole-side surfaces of the pair of permanent magnets 46. That is to say, one in each pair of the extended portions 47*b* is connected to the front surface of the front permanent magnet 46, and the other in each pair of the extended portions 47*b* is connected to the rear surface of the rear permanent magnet 46.

In such a way, a magnetic flux that comes out of the pair of permanent magnets 46 is attracted to the yokes 47, whereby a leakage flux is suppressed, a magnetic flux density in the vicinities of the contacts can be enhanced, and force to extend the arcs generated between the contacts can be increased. That is to say, by providing the yokes 47, it becomes possible to maintain the force to extend the arcs even if a size of the permanent magnets 46 is reduced, and miniaturization and cost reduction of the contact device can be achieved while maintaining arc cutoff performance.

Next, a description is made of operations of the contact device 10 with the above-described configuration.

In the contact device 10 with the above-described configuration in an initial state (state where the excitation winding 22 is not energized), the movable iron core 25 slides downward by urging force of the return spring 27, and following this, the movable shaft 8 also moves downward. In such a way, the movable contactor 35 is pressed downward by the adjustment plate 61, and moves downward together with the adjustment plate 61. That is to say, in the initial state, the movable contacts 34 are spaced apart from the fixed contacts 32.

Then, when the excitation winding 22 is energized, the movable iron core 25 is attracted to the fixed iron core 24 and moves upward. When the movable iron core 25 moves upward as described above, the movable shaft 8 coupled to the movable iron core 25 also moves upward in interlocking therewith. In such a way, the spring receiving portion 7 (holding portion 5) connected to the movable shaft 8 moves to the fixed contact 32 side, and the movable contactor 35 also moves upward following this movement. Then, the movable contacts 34 abut against the fixed contacts 32, and the contacts conduct to each other.

Meanwhile, when the excitation winding 22 is de-energized, the movable iron core 25 slides downward by the urging force of the return spring 27, and following this, the movable shaft 8 also moves downward. In such a way, the spring receiving portion 7 (holding portion 5) also moves downward, and the movable contactor 35 also moves downward following this movement, and accordingly, the fixed contacts 32 and the movable contacts 34 are spaced apart from each other.

Figure 5:
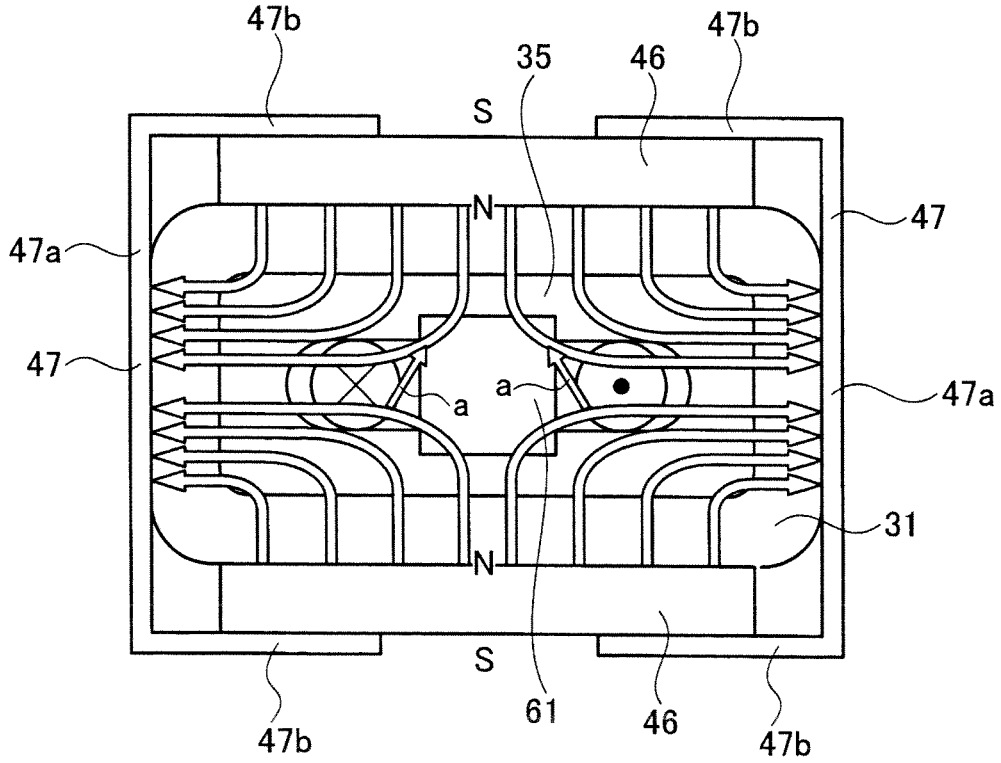
FIG. 5 is a plan view schematically showing a main portion of the contact device according to the first embodiment of the present invention.

Here, in this embodiment, the pair of permanent magnets 46 is arranged around the contact block 3, and accordingly, as shown in FIG. 5, a magnetic field is formed around the contact block 3 by the pair of permanent magnets 46. Therefore, the arcs generated between the fixed contacts 32 and the movable contacts 34 (between the contacts) are extended and extinguished in directions, which leave each other, in whichever direction a direction of the current flowing through the movable contactor 35 may be. This is described in detail. In FIG. 5, in a case where the current flows through the movable contactor 35 from the left to the right, the arc generated between the left contacts is extended to the left rear, and the arc generated between the right contacts is extended to the right rear, whereby a short circuit of the arcs can be prevented. Moreover, in FIG. 5, in a case where the current flows through the movable contactor 35 from the right to the left, the arc generated between the left contacts is extended to the left front, and the arc generated between the right contacts is extended to the right front, whereby the short circuit of the arcs is prevented.

However, in a case where the surfaces of the pair of permanent magnets 46, which have the same polarity, are opposed to each other, then as shown in FIG. 5, a region where the magnetic field becomes thin is formed on a center portion of the movable contactor 35 (that is, such an inside of the contacts: the side opposite to the other fixed terminal, the side being of the fixed terminal having the fixed contact in which the arc is generated at the contact portion).

Therefore, in such a case where the arc is generated in the inside of the contacts, it is apprehended that a cutoff time of the arc may be long since a motion of the arc is slow.

Moreover, as in this embodiment, in such a case where the adjustment plate 61 that has the function as the yoke is arranged on the center portion of the movable contactor 35, in the event where the arcs are generated in the insides of the contacts where the magnetic field is weak, the arcs are extended in directions to the adjustment plate 61 arranged on the center portion (for the directions, refer to arrows a of FIG. 5), then it is apprehended that the arcs may cause arc-over to the adjustment plate 61, and that the cutoff performance may be lowered. Moreover, even in a case where the yoke is provided separately from the adjustment plate 61, and the adjustment plate 61 is used as a holder, then it is apprehended that the arcs may cause the arc-over to the adjustment plate 61, and that the cutoff performance may be lowered. Note that, even in a case where the surfaces of the pair of permanent magnets, which have different polarities, are opposed to each other, if a configuration is adopted so that the arcs generated in the event where the contacts contact and leave each other can be extended to the outsides by the force of the permanent magnets, then it is apprehended that it may take long to extend the arcs to the outsides in the case where the arcs are generated in the insides of the contacts.

As described above, in either of the cases, when the arcs are generated in the insides of the contacts, it is apprehended that the arc cutoff performance of the contact device may be lowered. Such a problem will significantly appear particularly in a case where the contacts waste.

Accordingly, in this embodiment, it is made possible to suppress the arcs from being generated in the insides of the contacts.

Specifically, in at least one fixed terminal 33 among the plurality of fixed terminals 33, the fixed contact 32 and the movable contact 34 are allowed to abut against each other in a region other than a side opposite to the other fixed terminal 33.

In this embodiment, in both of the pair of fixed terminals 33, that is, in all of the fixed terminals 33, the fixed contacts 32 formed on the individual fixed terminals 33 are allowed to abut against the movable contacts 34 in such regions other than the sides (insides of the contacts) opposite to the fixed terminals 33 on others' sides.

Specifically, as shown in FIG. 2(*a*), on the movable contactor 35, inclined surfaces 35*a* are formed, which become lower in height as going toward insides thereof (center (movable shaft 8) sides in the right-and-left direction when viewed from the above). The inclined surfaces 35*a* are formed as described above, whereby the fixed contacts 32 formed on the individual fixed terminals 33 are allowed not to abut against the movable contacts 34 in the insides of the contacts, but are allowed to abut against the movable contacts 34 only on the outsides (upper and outside regions of the inclined surfaces 35*a*) of the contacts. Note that, in this embodiment, the shape of the movable contactor 35 is formed into a shape in which a recessed portion is formed on a center portion of an upper surface, whereby the inclined surfaces 35*a* are formed right and left.

As described above, in this embodiment, the at least one fixed terminal 33 among the plurality of fixed terminals 33 is allowed to abut against the movable contact 34 in the region other than the side opposite to the other fixed terminal 33 in such an event where the movable contact 34 abuts against the fixed contact 32 of the one fixed terminal 33. Therefore, the arcs can be suppressed from being generated in the insides of the contacts in the event where the contacts contact and leave each other. As a result, it becomes possible to suppress the lowering of the arc cutoff performance of the contact device 10.

In particular, in this embodiment, in all of the fixed terminals 33, the fixed contacts 32 formed on the individual fixed terminals 33 are allowed to abut against the movable contacts 34 on the regions other than the sides (insides of the contacts) opposite to the fixed terminals 33 on the others' sides. Therefore, it becomes possible to further suppress the arcs from being generated in the insides of the contacts in the event where the contacts contact and leave each other.

Moreover, in this embodiment, the pair of permanent magnets 46 are arranged opposite to each other through the contact block 3 in the back-and-forth direction (direction perpendicular to the contacting/leaving direction (up-and-down direction) of the movable contacts 34 and the fixed contacts 32). Then, the pair of permanent magnets 46 is arranged so that the polarities of the surfaces thereof opposite to each other can be the same. As described above, the surfaces of the pair of permanent magnets 46, which have the same polarity, are opposed to each other, whereby the arcs generated between the fixed contacts 32 and the movable contacts 34 (between the contacts) can be extended and extinguished in the directions leaving each other irrespective of the direction of the current flowing through the movable contactor 35.

Then, in a case of opposing the surfaces of the pair of permanent magnets 46, which have the same polarity, to each other, if the fixed contact 32 of the at least one fixed terminal 33 among the plurality of fixed terminals 33 is allowed to abut against the movable contact 34 in the region other than the side opposite to the other fixed terminal 33, then the arcs can be suppressed from being generated in the insides of the contacts where the magnetic field is weak.

Moreover, in this embodiment, even if the contacts waste, the lowering of the cutoff performance can be suppressed in a full life range of the contact device 10 since it becomes possible to suppress the arcs from being generated in the insides of the contacts.

(Second Embodiment)

A contact device 10A according to this embodiment is different from the contact device 10 of the above-described first embodiment in that the insulating member 39 is not provided, and other configurations thereof are configurations basically similar to those of the above-described first embodiment.

Specifically, also in this embodiment, in the at least one fixed terminal 33 among the plurality of fixed terminals 33, the fixed contact 32 and the movable contact 34 are allowed to abut against each other in the region other than the side opposite to the other fixed terminal 33, thus making it possible to suppress the arc from being generated in the inside of the contact.

Then, in both of the pair of fixed terminals 33, that is, in all of the fixed terminals 33, the fixed contacts 32 formed on the individual fixed terminals 33 are allowed to abut against the movable contacts 34 in the regions other than the sides (insides of the contacts) opposite to the fixed terminals 33 on the others' sides.

Figure 6:
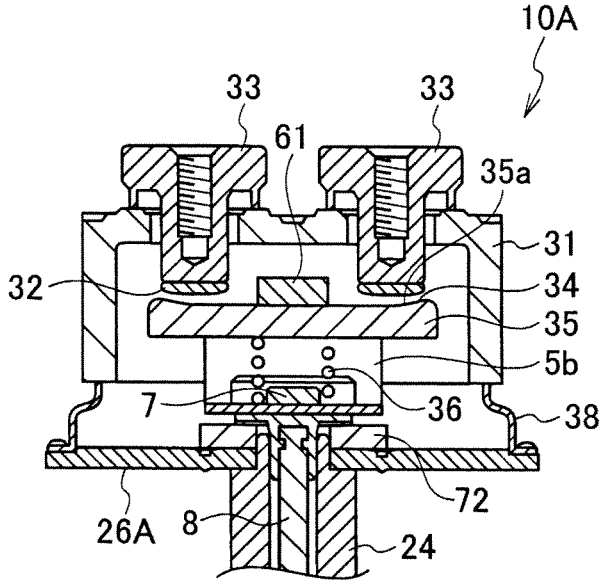
FIG. 6 is a side cross-sectional view showing a contact device according to a second embodiment of the present invention.
Figure 22:
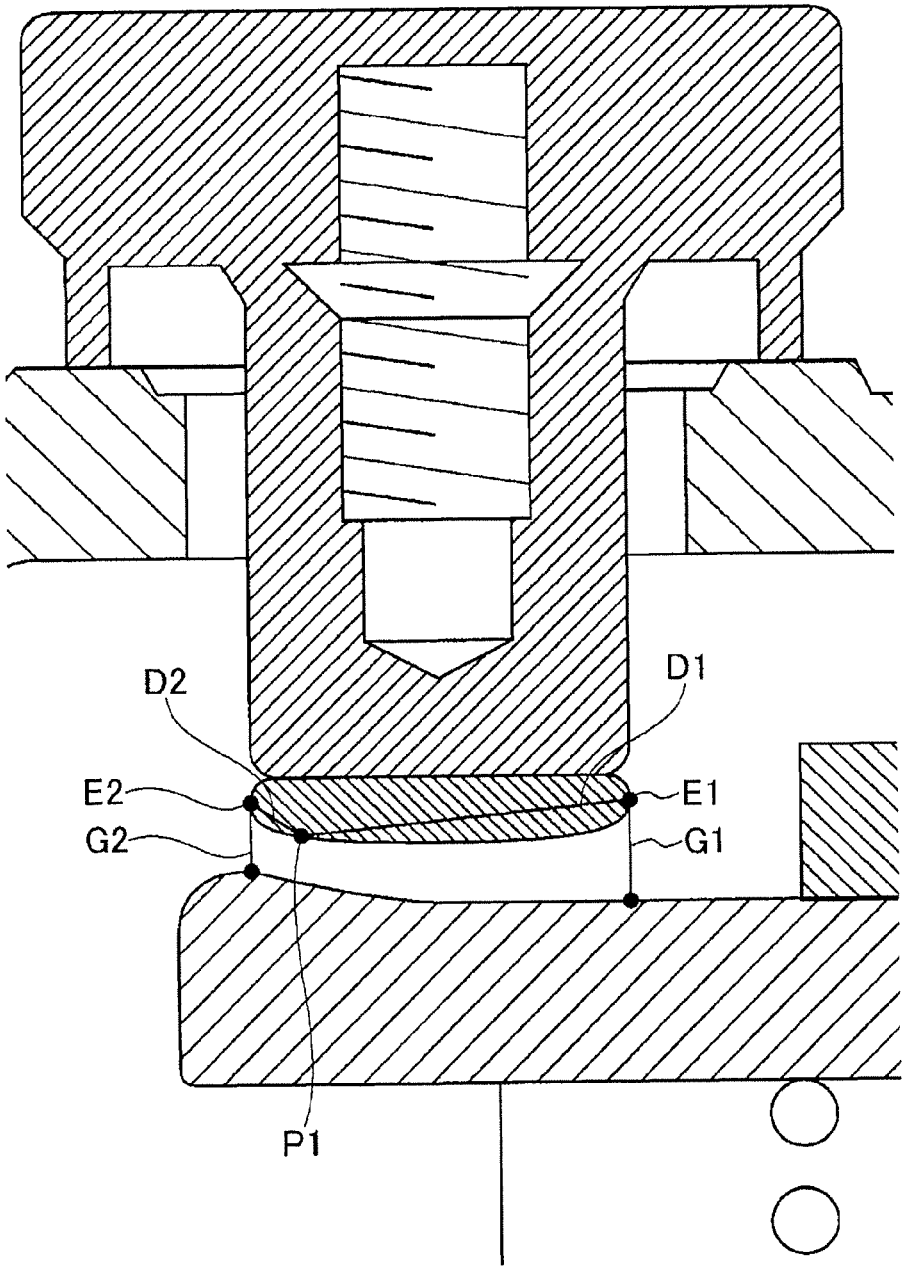
FIG. 22 is an enlarged side cross-sectional view showing a part of FIG. 6.

Moreover, also in this embodiment, the shape of the movable contactor 35 is formed such that the recessed portion is formed on the center portion of the upper surface, whereby the inclined surfaces 35*a*, which become lower in height toward the insides thereof (center (movable shaft 8) sides in the right-and-left direction when viewed from the above) are formed on the movable contactor 35 (refer to FIG. 6). Note that reference numeral 72 of FIG. 6 denotes a stopper. Furthermore, as shown in FIG. 22, which is an enlarged side cross-sectional view showing a part of FIG. 6, reference numeral El of FIG. 22 denotes a first end portion. Reference numeral E2 denotes a second end portion. Reference numeral P1 denotes a portion at which the fixed contact 32 of the at least one fixed terminal 33 abuts against the movable contact 34. Reference numeral D1 denotes a shortest distance between the first end portion El and the portion P1 at which the fixed contact 32 of the at least one fixed terminal 33 abuts against the movable contact 34. Reference numeral D2 denotes a shortest distance between the second end portion E2 and the portion P1 at which the fixed contact 32 of the at least one fixed terminal 33 abuts against the movable contact 34. Reference numeral G1 denotes a gap between the first end portion El and the movable contactor 35 opposed to the first end portion El in the movement direction of the movable contactor 35. Reference numeral G2 denotes a gap between the second end portion E2 and the movable contactor 35 opposed to the second end portion E2 in the movement direction of the movable contactor 35.

Also according to this embodiment described above, similar functions and effects to those of the above-described first embodiment can be exerted.

Next, a description is made of modification examples of this embodiment.

(First Modification Example)

In a contact device 10B according to this modification example, a shape of the movable contactor 35 is different from the shape of the movable contactor 35 of the above-described second embodiment; however, other configurations are basically similar to those of the contact device 10A of the above-described second embodiment.

Figure 7:
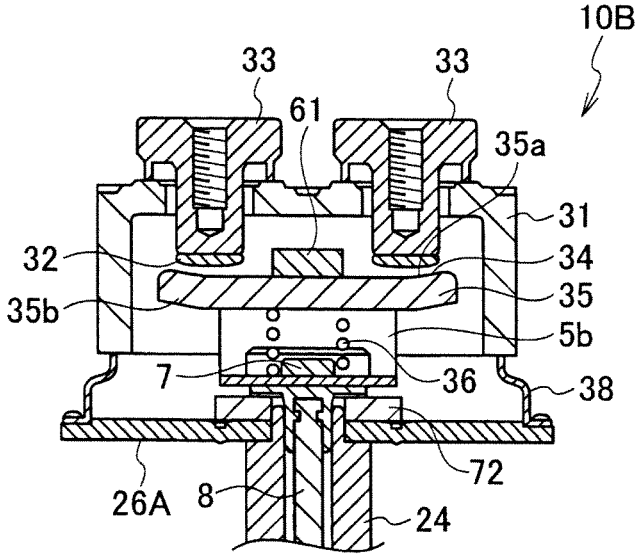
FIG. 7 is a main portion enlarged cross-sectional view showing a contact device according to a first modification example of the second embodiment of the present invention.

Specifically, as shown in FIG. 7, outsides in the right-and-left direction of the movable contactor 35 are bent upward to form bent portions 35*b*, whereby the inclined surfaces 35*a*, which become lower in height toward the insides thereof (center (movable shaft 8) sides in the right-and-left direction when viewed from the above), are formed.

Also according to this modification example described above, similar functions and effects to those of the above-described second embodiment can be exerted.

(Second Modification Example)

In a contact device 10C according to this modification example, a shape of the movable contactor 35 is different from the shape of the movable contactor 35 of the above-described second embodiment; however, other configurations are basically similar to those of the contact device 10A of the above-described second embodiment.

Figure 8:
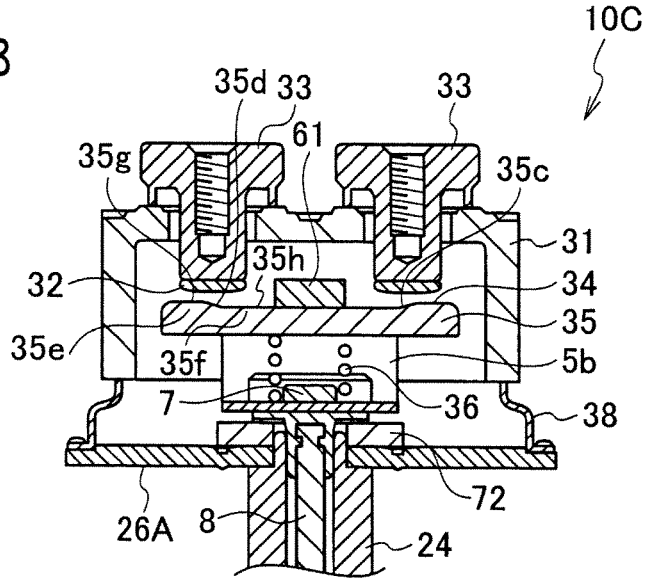
FIG. 8 is a main portion enlarged cross-sectional view showing a contact device according to a second modification example of the second embodiment of the present invention.

Specifically, as shown in FIG. 8, step difference portions 35*c*, in which insides (center (movable shaft 8) sides in the right-and-left direction when viewed from the above) become lower in height, are formed on the movable contactor 35 (movable contactor side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, step difference surfaces 35*d*, each of which couples step differences (upper step portion 35*e* and lower step portion 35*f*) of the step difference portion 35*c* to each other, are formed as inclined surfaces. Moreover, upper surfaces 35*g* of the upper step portions 35*e* are formed as the movable contacts 34, and upper surfaces 35*h* of the lower step portions 35*f* are allowed not to abut against the fixed contacts 32.

Figure 23:
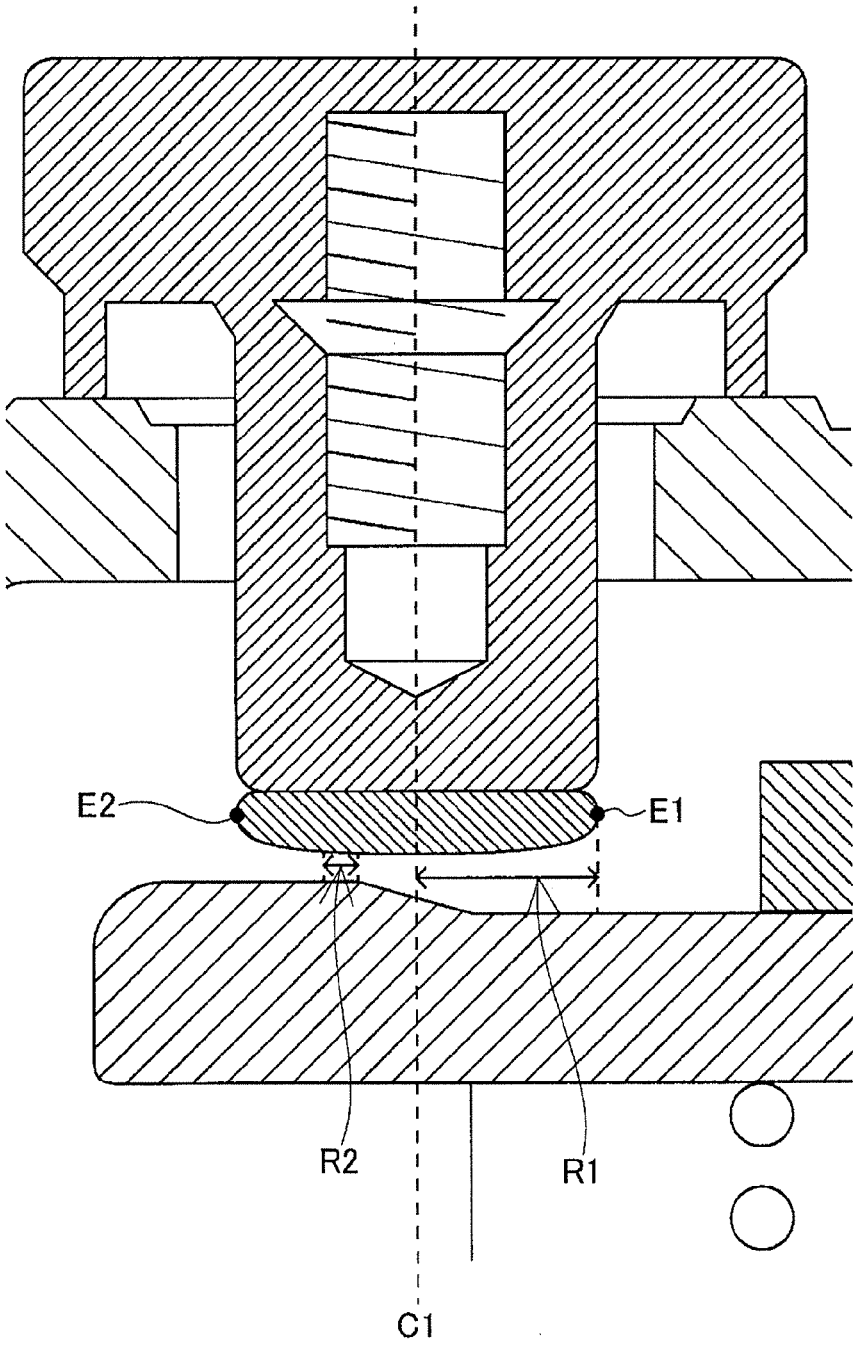
FIG. 23 is an enlarged side cross-sectional view showing a part of FIG. 8.

Then, in this modification example, the shape of the movable contactor 35 is formed into the shape in which the recessed portion is formed on the center portion of the upper surface, whereby the step difference portions 35c are formed. Note that, as shown in FIG. 23, which is an enlarged side cross-sectional view showing a part of FIG. 8, reference numeral E1 of FIG. 23 denotes a first end portion. Reference numeral E2 denotes a second end portion. Reference numeral C1 denotes a center portion. Reference numeral R1 denotes a non-contact region provided between the center portion C1 and the first end portion E1. Reference numeral R2 denotes a contact region provided between the center portion C1 and the second end portion E2. As shown in FIG. 23, the fixed contact 32 of the at least one fixed terminal 33 abuts against the movable contact 34 between the center portion C1 and the second end portion E2, and the fixed contact 32 of the at least one fixed terminal 33 does not abut against the movable contact 34 between the center portion C1 and the first end portion E1 . Therefore, in FIG. 23, the area of a region in which the fixed contact 32 of the at least one fixed terminal 33 abuts against the movable contact 34 between the center portion C1 and the first end portion E1 is zero. Namely, in FIG. 23, the area of the contact region R2 is larger than the area of the region in which the fixed contact 32 of the at least one fixed terminal 33 abuts against the movable contact 34 between the center portion C1 and the first end portion E1.

Also according to this modification example described above, similar functions and effects to those of the above-described second embodiment can be exerted.

Moreover, the step difference portions 35*c* are provided on the movable contactor 35, and the fixed contacts 32 formed on the fixed terminals 33 are allowed to abut against the movable contacts 34 in the regions other than the sides (insides of the contacts) opposite to the fixed terminals 33 on the others' sides, whereby it becomes possible to more surely allow the fixed contacts 32 formed on the fixed terminals 33 to abut against the movable contacts 34 on the outsides of the contacts.

Moreover, in this modification example, the step difference portion 35*c* are formed on the movable contactor side, and accordingly, a shape is imparted to a plate-like member, thus making it possible to form the step difference portions 35*c*, resulting in an advantage that it becomes easy to manufacture the contact device.

(Third Modification Example)

In a contact device 10D according to this modification example, a shape of the movable contactor 35 is different from the shape of the movable contactor 35 of the above-described second embodiment; however, other configurations are basically similar to those of the contact device 10C of the above-described second embodiment.

Figure 9:
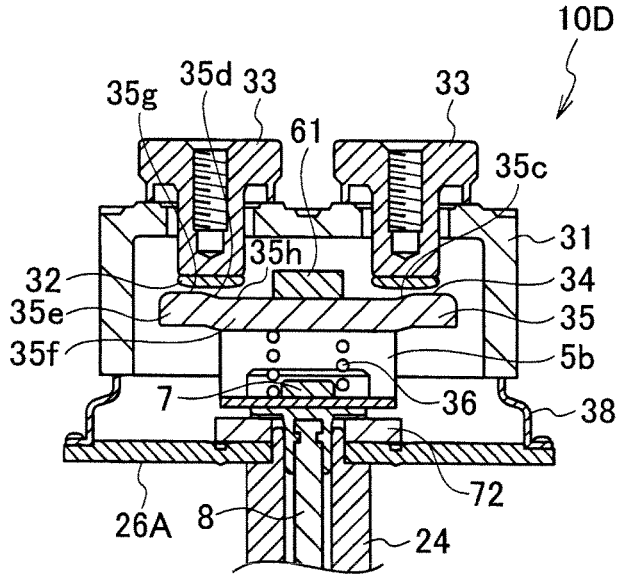
FIG. 9 is a main portion enlarged cross-sectional view showing a contact device according to a third modification example of the second embodiment of the present invention.

Specifically, as shown in FIG. 9, step difference portions 35*c*, in which insides (center (movable shaft 8) sides in the right-and-left direction when viewed from the above) become lower in height, are formed on the movable contactor 35 (movable contactor side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, the step difference surfaces 35*d*, each of which couples the step differences (upper step portion 35*e* and lower step portion 35*f*) of the step difference portion 35*c* to each other, are formed as inclined surfaces. Moreover, upper surfaces 35*g* of the upper step portions 35*e* are formed as the movable contacts 34, and upper surfaces 35*h* of the lower step portions 35*f* are allowed not to abut against the fixed contacts 32.

Then, in this modification example, the movable contactor 35 is press-molded so that the center portion in the right-and-left direction of the movable contactor 35 can be located to be lower in height, whereby the step difference portions 35*c* are formed.

Also in accordance with this modification example described above, similar functions and effects to those of the above-described second embodiment can be exerted.

Moreover, according to this modification example, the movable contactor 35 is press-molded, whereby the step difference portions 35*c* are formed, and accordingly, the step difference portions 35*c* can be formed more easily.

(Fourth Modification Example)

In a contact device 10E according to this modification example, a shape of the movable contactor 35 is different from the shape of the movable contactor 35 of the above-described third modification example; however, other configurations are basically similar to those of the contact device 10D of the above-described third modification example.

Figure 10:
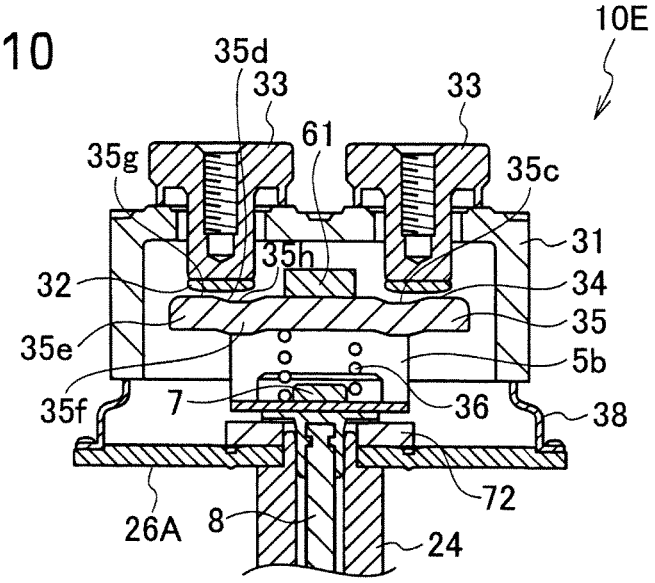
FIG. 10 is a main portion enlarged cross-sectional view showing a contact device according to a fourth modification example of the second embodiment of the present invention.

Specifically, as shown in FIG. 10, step difference portions 35*c*, in which insides (center (movable shaft 8) sides in the right-and-left direction when viewed from the above) become lower in height, are formed on the movable contactor 35 (movable contactor side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, the step difference surfaces 35*d*, each of which couples the step differences (upper step portion 35*e* and lower step portion 35*f*) of the step difference portion 35*c* to each other, are formed as inclined surfaces. Moreover, upper surfaces 35*g* of the upper step portions 35*e* are formed as the movable contacts 34, and upper surfaces 35*h* of the lower step portions 35*f* are allowed not to abut against the fixed contacts 32.

Then, in this modification example, the movable contactor 35 is press-molded so that the center portion in the right-and-left direction of the movable contactor 35 can be located to be lower in height, whereby the step difference portions 35*c* are formed.

At this time, only regions of the movable contactor 35, which are opposite to the insides of the fixed contacts 32 in the right-and-left direction, are press-molded, whereby the step difference portions 35*c* are formed. That is to say, the center portion in the right-and-left direction of the movable contactor 35 is not pressed, and positions of upper and lower surfaces thereof are located at the same height as those of the upper step portions 35*e* of the step difference portions 35*c*.

Also according to this modification example described above, similar functions and effects to those of the above-described third modification example can be exerted.

Moreover, according to this modification example, only the regions of the movable contactor 35, which are opposite to the insides of the fixed contacts 32, are press-molded, whereby the step difference portions 35*c* are formed. That is to say, the center portion in the right-and-left direction of the movable contactor 35 is not pressed, and the positions of the upper and lower surfaces thereof are located at the same height as those of the upper step portions 35*e* of the step difference portions 35*c*. Therefore, an arrangement space of the contact pressure spring 36 can be made unchangeable from the conventional one, and it becomes possible to achieve space saving.

(Fifth Modification Example)

In a contact device 10F according to this modification example, a shape of the movable contactor 35 is different from the shape of the movable contactor 35 of the above-described second modification example; however, other configurations are basically similar to those of the contact device 10C of the above-described second modification example.

Specifically, step difference portions 35*c*, in which insides (center (movable shaft 8) sides in the right-and-left direction when viewed from the above) become lower in height, are formed on the movable contactor 35 (movable contactor side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, the step difference surfaces 35*d*, each of which couples the step differences (upper step portion 35*e* and lower step portion 35*f*) of the step difference portion 35*c* to each other, are formed as inclined surfaces. Moreover, upper surfaces 35*g* of the upper step portions 35*e* are formed as the movable contacts 34, and upper surfaces 35*h* of the lower step portions 35*f* are allowed not to abut against the fixed contacts 32.

Then, in this modification example, the shape of the movable contactor 35 is formed into the shape in which the recessed portion is formed on the center portion of the upper surface, whereby the step difference portions 35*c* are formed.

Figure 11:
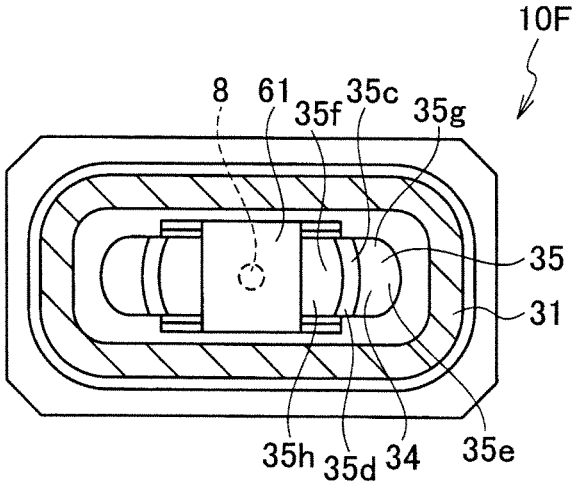
FIG. 11 is a main portion enlarged plan view showing a contact device according to a fifth modification example of the second embodiment of the present invention.

Moreover, in this modification example, as shown in FIG. 11, the step difference portions 35*c* are formed to have a circular arc shape taking the movable shaft (driving shaft) 8 of the movable contactor 35 as a substantial center when viewed from the above.

That is to say, each of the step difference portions 35*c* is formed so that a boundary line of the step difference surface 35*d* with the upper step portion 35*e* and a boundary line thereof with the lower step portion 35*f* can be concentric to each other.

Also in accordance with this modification example described above, similar functions and effects to those of the above-described second modification example can be exerted.

Moreover, according to this modification example, the step difference portions 35*c* are formed to have the circular arc shape taking the movable shaft (driving shaft) 8 of the movable contactor 35 as a substantial center when viewed from the above. Incidentally, it is naturally possible to form the step difference portions 35*c* linearly in the back-and-forth direction; however, in that case, it is necessary to set contacting points more on the outsides in consideration of the fact that the contacting points are changed in an event where the movable contactor 35 rotates, and effectively usable contact regions are reduced. As opposed to this, if the step difference portions 35*c* are formed to have the circular arc shape taking the movable shaft (driving shaft) 8 of the movable contactor 35 as a substantial center when viewed from the above, then the contacting points can be made unchangeable even if the movable contactor 35 rotates. Therefore, it is made possible to further widen the effectively usable contact regions, and to use the contact regions effectively.

Note that this modification example is also applicable to the step difference portions 35*c* of the movable contactors 35 shown in the third modification examples and the fourth modification examples.

(Sixth Modification Example)

In a contact device 10G according to this modification example, a shape of the movable contactor 35 is different from the shape of the movable contactor 35 of the above-described second modification example; however, other configurations are basically similar to those of the contact device 10C of the above-described second modification example.

Figure 12:
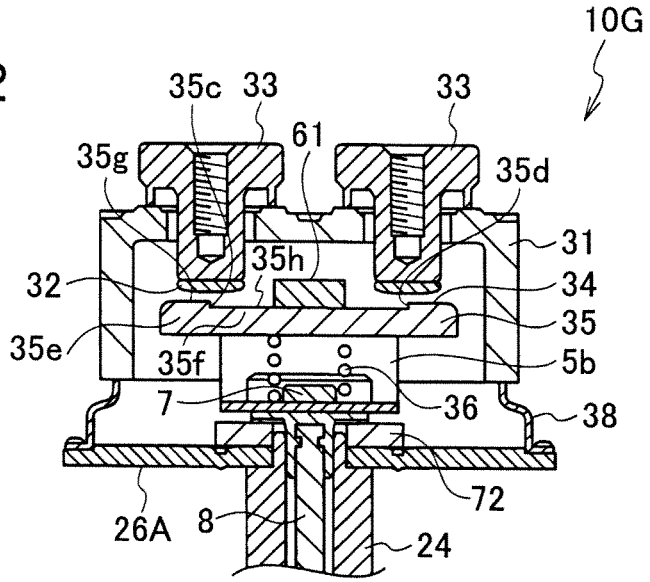
FIG. 12 is a main portion enlarged cross-sectional view showing a contact device according to a sixth modification example of the second embodiment of the present invention.

Specifically, as shown in FIG. 12, step difference portions 35*c*, in which insides (center (movable shaft 8) sides in the right-and-left direction when viewed from the above) become lower in height, are formed on the movable contactor 35 (movable contactor side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, the step difference surfaces 35*d*, each of which couples the step differences (upper step portion 35*e* and lower step portion 35*f*) of the step difference portion 35*c* to each other, are formed as perpendicular surfaces (surfaces extending in the contacting/leaving direction (up-and-down direction) of the fixed contacts 32 and the movable contacts 34). Moreover, upper surfaces 35*g* of the upper step portions 35*e* are formed as the movable contacts 34, and upper surfaces 35*h* of the lower step portions 35*f* are allowed not to abut against the fixed contacts 32.

Then, in this modification example, the shape of the movable contactor 35 is formed into the shape with the recessed portion formed on the center portion of the upper surface, whereby the step difference portions 35*c* are formed.

Also according to this modification example described above, similar functions and effects to those of the above-described second modification example can be exerted.

Moreover, according to this modification example, the step difference surfaces 35*d*, each of which couples the step differences (upper step portion 35*e* and lower step portion 35*f*) of the step difference portion 35*c* to each other, are formed as perpendicular surfaces (surfaces extending in the contacting/leaving direction (up-and-down direction) of the fixed contacts 32 and the movable contacts 34). Incidentally, if the step difference surfaces 35*d*, each of which couples the step differences (upper step portion 35*e* and lower step portion 35*f*) of the step difference portion 35*c* to each other, are inclined surfaces, then the contacting points enter the insides in the event where the contacts waste. Therefore, it is necessary to set the contacting points more on the outsides, and the effectively usable contact regions are reduced. As opposed to this, if the step difference surfaces 35*d* are formed as the perpendicular surfaces (surfaces extending in the contacting/leaving direction (up-and-down direction) of the fixed contacts 32 and the movable contacts 34), then the contacting points can be made unchangeable even if the contacts waste. Therefore, it is made possible to further widen the effectively usable contact regions, and to use the contact regions effectively.

Note that the configuration of the above-described fifth modification example is also applicable to this modification example.

(Seventh Modification Example)

In a contact device 10H according to this modification example, a shape of the movable contactor 35 is different from the shape of the movable contactor 35 of the above-described third modification example; however, other configurations are basically similar to those of the contact device 10D of the above-described third modification example.

Figure 13:
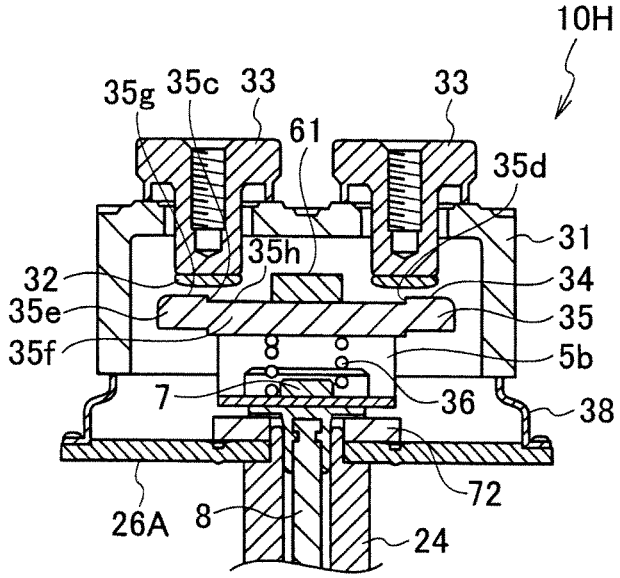
FIG. 13 is a main portion enlarged cross-sectional view showing a contact device according to a seventh modification example of the second embodiment of the present invention.

Specifically, as shown in FIG. 13, step difference portions 35*c*, in which insides (center (movable shaft 8) sides in the right-and-left direction when viewed from the above) become lower in height, are formed on the movable contactor 35 (movable contactor side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, the step difference surfaces 35*d*, each of which couples the step differences (upper step portion 35*e* and lower step portion 35*f*) of the step difference portion 35*c* to each other, are formed as perpendicular surfaces (surfaces extending in the contacting/leaving direction (up-and-down direction) of the fixed contacts 32 and the movable contacts 34). Moreover, upper surfaces 35*g* of the upper step portions 35*e* are formed as the movable contacts 34, and upper surfaces 35*h* of the lower step portions 35*f* are allowed not to abut against the fixed contacts 32.

Then, in this modification example, the movable contactor 35 is press-molded so that the center portion in the right-and-left direction of the movable contactor 35 can be located to be lower in height, whereby the step difference portions 35*c* are formed.

Also according to this modification example described above, similar functions and effects to those of the above-described third embodiment can be exerted.

Moreover, according to this modification example, the step difference surfaces 35*d*, each of which couples the step differences (upper step portion 35*e* and lower step portion 35*f*) of the step difference portion 35*c* to each other, are formed as perpendicular surfaces (surfaces extending in the contacting/leaving direction (up-and-down direction) of the fixed contacts 32 and the movable contacts 34). Incidentally, if the step difference surfaces 35*d*, each of which couples the step differences (upper step portion 35*e* and lower step portion 35*f*) of the step difference portion 35*c* to each other, are inclined surfaces, then the contacting points enter the insides in the event where the contacts waste. Therefore, it is necessary to set the contacting points more on the outsides, and the effectively usable contact regions are reduced. As opposed to this, if the step difference surfaces 35*d* are formed as the perpendicular surfaces (surfaces extending in the contacting/leaving direction (up-and-down direction) of the fixed contacts 32 and the movable contacts 34), then the contacting points can be made unchangeable even if the contacts waste. Therefore, it is made possible to further widen the effectively usable contact regions, and to use the contact regions effectively.

Note that the configuration of the above-described fifth modification example is also applicable to this modification example.

(Eighth Modification Example)

In a contact device 10I according to this modification example, a shape of the movable contactor 35 is different from the shape of the movable contactor 35 of the above-described fourth modification example; however, other configurations are basically similar to those of the contact device 10E of the above-described fourth modification example.

Figure 14:
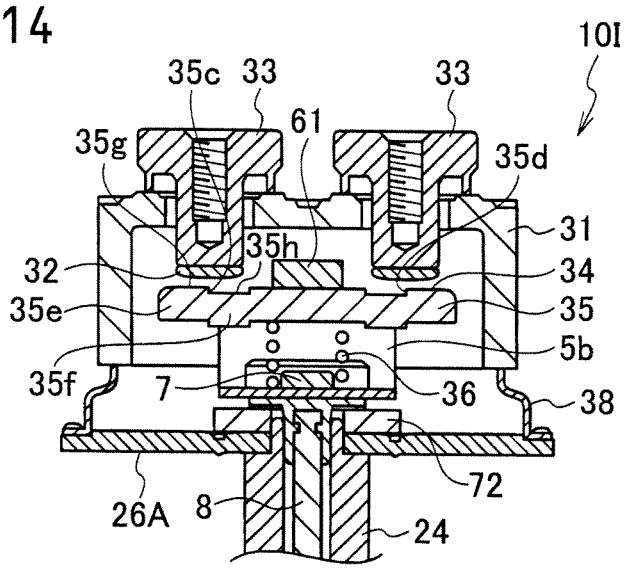
FIG. 14 is a main portion enlarged cross-sectional view showing a contact device according to an eighth modification example of the second embodiment of the present invention.

Specifically, as shown in FIG. 14, step difference portions 35*c*, in which insides (center (movable shaft 8) sides in the right-and-left direction when viewed from the above) become lower in height, are formed on the movable contactor 35 (movable contactor side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, the step difference surfaces 35*d*, each of which couples the step differences (upper step portion 35*e* and lower step portion 35*f*) of the step difference portion 35*c* to each other, are formed as perpendicular surfaces. Moreover, upper surfaces 35*g* of the upper step portions 35*e* are formed as the movable contacts 34, and upper surfaces 35*h* of the lower step portions 35*f* are allowed not to abut against the fixed contacts 32.

Then, in this modification example, the movable contactor 35 is press-molded so that the center portion in the right-and-left direction of the movable contactor 35 can be located to be lower in height, whereby the step difference portions 35*c* are formed.

At this time, only regions of the movable contactor 35, which are opposite to the insides of the fixed contacts 32 in the right-and-left direction, are press-molded, whereby the step difference portions 35*c* are formed. That is to say, the center portion in the right-and-left direction of the movable contactor 35 is not pressed, and positions of upper and lower surfaces thereof are located at the same height as those of the upper step portions of the step difference portions 35*c*.

Also according to this modification example described above, similar functions and effects to those of the above-described third modification example can be exerted.

Moreover, according to this modification example, the step difference surfaces 35*d*, each of which couples the step differences (upper step portion 35*e* and lower step portion 35*f*) of the step difference portion 35*c* to each other, are formed as perpendicular surfaces (surfaces extending in the contacting/leaving direction (up-and-down direction) of the fixed contacts 32 and the movable contacts 34). Incidentally, if the step difference surfaces 35*d*, each of which couples the step differences (upper step portion 35*e* and lower step portion 35*f*) of the step difference portion 35*c* to each other, are inclined surfaces, then the contacting points enter the insides in the event where the contacts waste. Therefore, it is necessary to set the contacting points more outward, and the effectively usable contact regions are reduced. As opposed to this, if the step difference surfaces 35*d* are formed as the perpendicular surfaces (surfaces extending in the contacting/leaving direction (up-and-down direction) of the fixed contacts 32 and the movable contacts 34), then the contacting points can be made unchangeable even if the contacts waste. Therefore, it is made possible to further widen the effectively usable contact regions, and to use the contact regions effectively.

Note that the configuration of the above-described fifth modification example is also applicable to this modification example.

(Ninth Modification Example)

In a contact device 10J according to this modification example, a shape of the fixed contacts 32 is different from the shape of the fixed contacts 32 of the above-described second embodiment; however, other configurations are basically similar to those of the contact device 10A of the above-described second embodiment.

Figure 15:
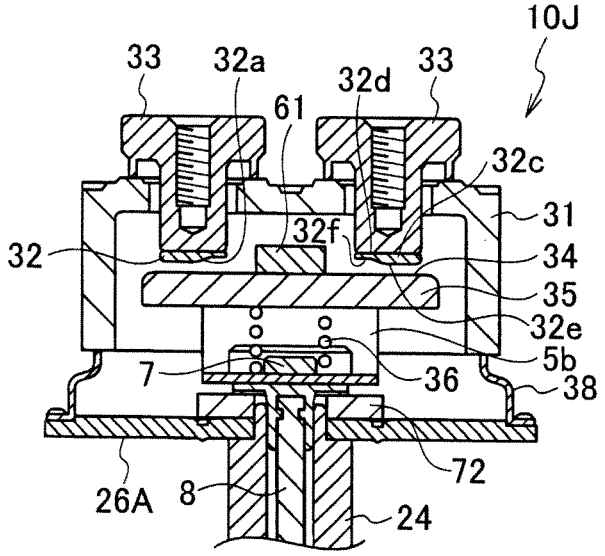
FIG. 15 is a main portion enlarged cross-sectional view showing a contact device according to a ninth modification example of the second embodiment of the present invention.

Specifically, as shown in FIG. 15, step difference portions 32*a*, in which insides (sides opposite to the fixed terminals on the others' sides) become higher in height, are formed on the fixed contacts 32 (fixed terminal side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, step difference surfaces 32*b*, each of which couples step differences (lower step portion 32*c* and upper step portion 32*d*) of the step difference portion 32*a* to each other, are formed as inclined surfaces. Moreover, the step difference portions or the inclined surfaces are not formed on the movable contactor 35. Hence, in the fixed contacts 32, only lower surfaces 32*e* of the lower step portions 32*c* among the step difference portions 32*a* abut against the movable contacts 34 of the movable contactor 35, and the step difference surfaces 32*b* and lower surfaces 32*f* of the upper step portions 32*d* do not abut against the movable contacts 34, that is, the movable contactor 35.

Also according to this modification example described above, similar functions and effects to those of the above-described second embodiment can be exerted.

Moreover, according to this modification example, the step difference portions 32*a*, in which the insides (sides opposite to the fixed terminals on the others' sides) become higher in height, are formed on the fixed contacts 32 (fixed terminal side), whereby the fixed contacts 32 formed on the fixed terminals 33 are allowed to abut against the movable contacts 34 in the regions other than the sides (insides of the contacts) opposite to the fixed terminals 33 on the others' sides. Therefore, the contacting points can be made unchangeable even if the movable contactor 35 rotates. That is to say, by providing the step difference portions on the fixed terminal side, it becomes unnecessary to consider the rotation of the movable contactor 35 as in the case of providing the step difference portions on the movable contact or side. As a result, it is made possible to further widen the effectively usable contact regions, and to use the contact regions effectively.

(Tenth Modification Example)

In a contact device 10K according to this modification example, a shape of the fixed contacts 32 is different from the shape of the fixed contacts 32 of the above-described ninth modification example; however, other configurations are basically similar to those of the contact device 10J of the above-described ninth modification example.

Figure 16:
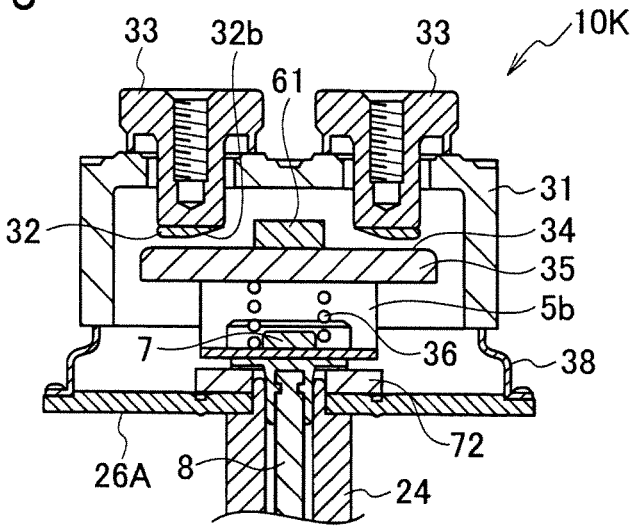
FIG. 16 is a main portion enlarged cross-sectional view showing a contact device according to a tenth modification example of the second embodiment of the present invention.

Specifically, as shown in FIG. 16, inclined surfaces 32*b*, in which insides (sides opposite to the fixed terminals on the others' sides) become higher in height, are formed on the fixed contacts 32 (fixed terminal side), whereby the fixed contacts 32 formed on the fixed terminals 33 are allowed to abut against the movable contacts 34 in the regions other than the sides (insides of the contacts) opposite to the fixed terminals 33 on the others' sides.

Note that, also in this modification example, the step difference portions or the inclined surfaces are not formed on the movable contactor 35.

Also according to this modification example described above, similar functions and effects to those of the above-described ninth modification example can be exerted.

(Eleventh Modification Example)

In a contact device 10L according to this modification example, a shape of the fixed contacts 32 is different from the shape of the fixed contacts 32 of the above-described ninth modification example; however, other configurations are basically similar to those of the contact device 10J of the above-described ninth modification example.

Figure 17:
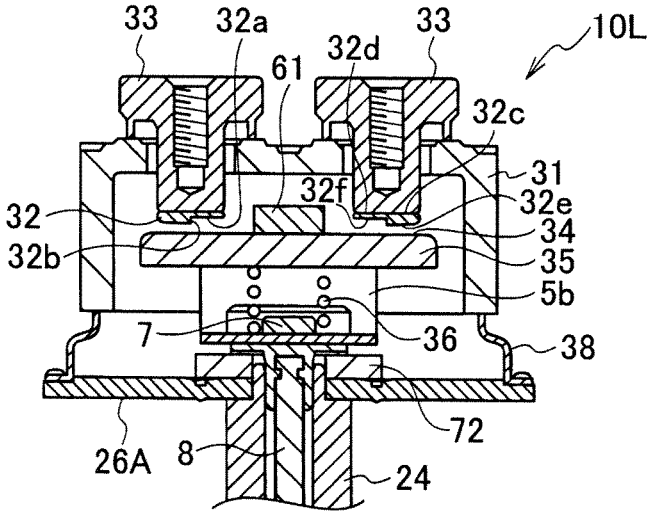
FIG. 17 is a main portion enlarged cross-sectional view showing a contact device according to an eleventh modification example of the second embodiment of the present invention.

Specifically, as shown in FIG. 17, step difference portions 32*a*, in which insides (sides opposite to the fixed terminals on the others' sides) become higher in height, are formed on the fixed contacts 32 (fixed terminal side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, step difference surfaces 32*b*, each of which couples step differences (lower step portion 32*c* and upper step portion 32*d*) of the step difference portion 32*a* to each other, are formed as perpendicular surfaces (surfaces extending in the contacting/leaving direction (up-and-down direction) of the fixed contacts 32 and the movable contacts 34). Moreover, the step difference portions or the inclined surfaces are not formed on the movable contactor 35. Hence, in the fixed contacts 32, only lower surfaces 32*e* of the lower step portions 32*c* among the step difference portions 32*a* abut against the movable contacts 34 of the movable contactor 35, and the step difference surfaces 32*b* and lower surfaces 32*f* of the upper step portions 32*d* do not abut against the movable contacts 34, that is, the movable contactor 35.

Also according to this modification example described above, similar functions and effects to those of the above-described ninth modification example can be exerted.

Moreover, according to this modification example, the step difference surfaces 32*b*, each of which couples step differences (lower step portion 32*c* and upper step portion 32*d*) of the step difference portion 32*a* to each other, are formed as perpendicular surfaces (surfaces extending in the contacting/leaving direction (up-and-down direction) of the fixed contacts 32 and the movable contacts 34). Incidentally, if the step difference surfaces 32*b*, each of which couples the step differences (lower step portion 32*c* and upper step portion 32*d*) of the step difference portion 32*a* to each other, are inclined surfaces, then the contacting points enter the insides in the event where the contacts waste. Therefore, it is necessary to set the contacting points more outward, and the effectively usable contact regions are reduced. As opposed to this, if the step difference surfaces 32*b* are formed as the perpendicular surfaces (surfaces extending in the contacting/leaving direction (up-and-down direction) of the fixed contacts 32 and the movable contacts 34), then the contacting points can be made unchangeable even if the contacts waste. Therefore, it is made possible to further widen the effectively usable contact regions, and to use the contact regions effectively.

(Twelfth Modification Example)

In a contact device 10M according to this modification example, a shape of the fixed contacts 32 is different from the shape of the fixed contacts 32 of the above-described eleventh modification example; however, other configurations are basically similar to those of the contact device 10L of the above-described eleventh modification example.

Figure 18:
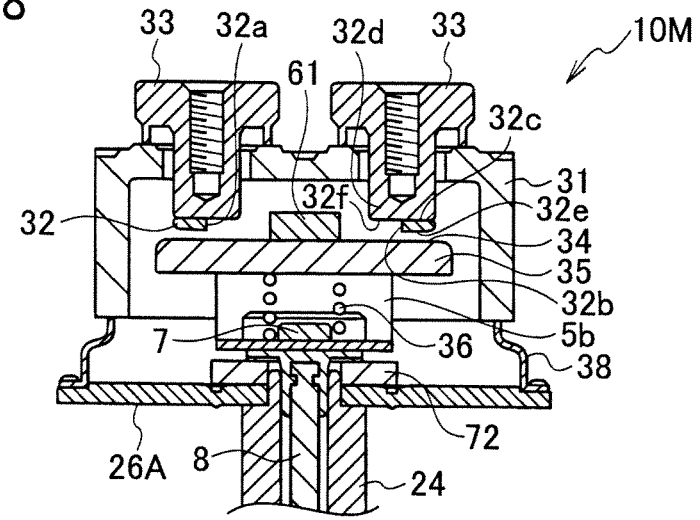
FIG. 18 is a main portion enlarged cross-sectional view showing a contact device according to a twelfth modification example of the second embodiment of the present invention.

Specifically, as shown in FIG. 18, step difference portions 32*a*, in which insides (sides opposite to the fixed terminals on the others' sides) become higher in height, are formed on the fixed contacts 32 (fixed terminal side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, step difference surfaces 32*b*, each of which couples step differences (lower step portion 32*c* and upper step portion 32*d*) of the step difference portion 32*a* to each other, are formed as perpendicular surfaces (surfaces extending in the contacting/leaving direction (up-and-down direction) of the fixed contacts 32 and the movable contacts 34). At this time, the step difference portion 32*a* is formed so that insides of the fixed terminals 33 can be exposed. That is to say, in this modification example, the fixed terminals 33 compose the upper step portions 32*d*. Moreover, the step difference portions or the inclined surfaces are not formed on the movable contactor 35. Hence, in the fixed contacts 32, only lower surfaces 32*e* of the lower step portions 32*c* among the step difference portions 32*a* abut against the movable contacts 34 of the movable contactor 35, and the step difference surfaces 32*b* and lower surfaces 32*f* of the upper step portions 32*d* do not abut against the movable contacts 34, that is, the movable contactor 35.

Also according to this modification example described above, similar functions and effects to those of the above-described eleventh modification example can be exerted.

(Thirteenth Modification Example)

In a contact device 10N according to this modification example, a shape of the fixed contacts 32 is different from the shape of the fixed contacts 32 of the above-described eleventh modification example; however, other configurations are basically similar to those of the contact device 10L of the above-described eleventh modification example.

Figure 19:
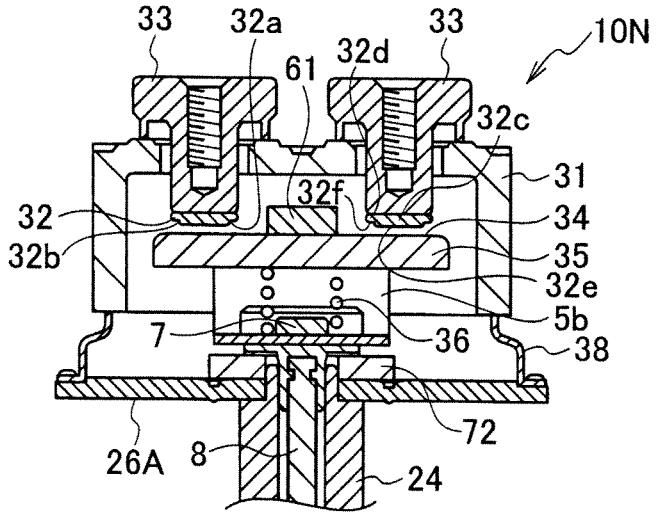
FIG. 19 is a main portion enlarged cross-sectional view showing a contact device according to a thirteenth modification example of the second embodiment of the present invention.

Specifically, as shown in FIG. 19, step difference portions 32*a*, in which insides (sides opposite to the fixed terminals on the others' sides) become higher in height, are formed on the fixed contacts 32 (fixed terminal side), whereby the fixed contacts 32 formed on the fixed terminals 33 are allowed to abut against the movable contacts 34 in the regions other than the sides (insides of the contacts) opposite to the fixed terminals 33 on the others' sides.

Note that, in this modification example, the step difference surfaces 32*b*, each of which couples the step differences (lower step portion 32*c* and upper step portion 32*d*) of the step difference portion 32*a* to each other, are formed as perpendicular surfaces (surfaces extending in the contacting/leaving direction (up-and-down direction) of the fixed contacts 32 and the movable contacts 34); however, the step difference surfaces 32*b* may be formed as such inclined surfaces.

Moreover, in this modification example, the step difference portions 32*a* are formed over the entire circumferences of the fixed terminals 33. Furthermore, the step difference portions or the inclined surfaces are not formed on the movable contactor 35. Hence, in the fixed contacts 32, only lower surfaces 32*e* of the lower step portions 32*c* among the step difference portions 32*a* abut against the movable contacts 34 of the movable contactor 35, and the step difference surfaces 32*b* and lower surfaces 32*f* of the upper step portions 32*d* do not abut against the movable contacts 34, that is, the movable contactor 35.

Also according to this modification example described above, similar functions and effects to those of the above-described eleventh modification example can be exerted.

Moreover, in accordance with this modification example, the step difference portions 32*a* are formed over the entire circumferences of the fixed terminals 33. As described above, if the step difference portions 32*a* are formed over the entire circumferences of the fixed terminals 33, then the step difference portions 32*a* can be allowed to be present in the insides (sides opposite to the fixed terminals on the others' sides) even if the fixed terminals 33 rotate at the time of assembling the fixed terminals 33. Therefore, it becomes unnecessary to position the fixed terminals at the time of assembling the fixed terminals 33, and it becomes easy to manufacture the contact device.

(Third Embodiment)

A contact device 10P according to this embodiment is different from the contact device 10 of the above-described first embodiment in that a magnetic circuit is formed by arranging the yoke 62 and the adjustment plate 61 so as to sandwich the movable contactor 35 therebetween, and in addition, that the movable shaft 8 is provided so as to penetrate the yoke 62, the movable contactor 35 and the adjustment plate 61, and other configurations thereof are configurations basically similar to those of the above-described first embodiment.

That is to say, also in this embodiment, in the at least one fixed terminal 33 among the plurality of fixed terminals 33, the fixed contact 32 and the movable contact 34 are allowed to abut against each other in the region other than the side opposite to the other fixed terminal 33, thus making it possible to suppress the arc from being generated in the inside of the contact.

Then, in both of the pair of fixed terminals 33, that is, in all of the fixed terminals 33, the fixed contacts 32 formed on the individual fixed terminals 33 are allowed to abut against the movable contacts 34 in the regions other than the sides (insides of the contacts) opposite to the fixed terminals 33 on the others' sides.

Figure 20:
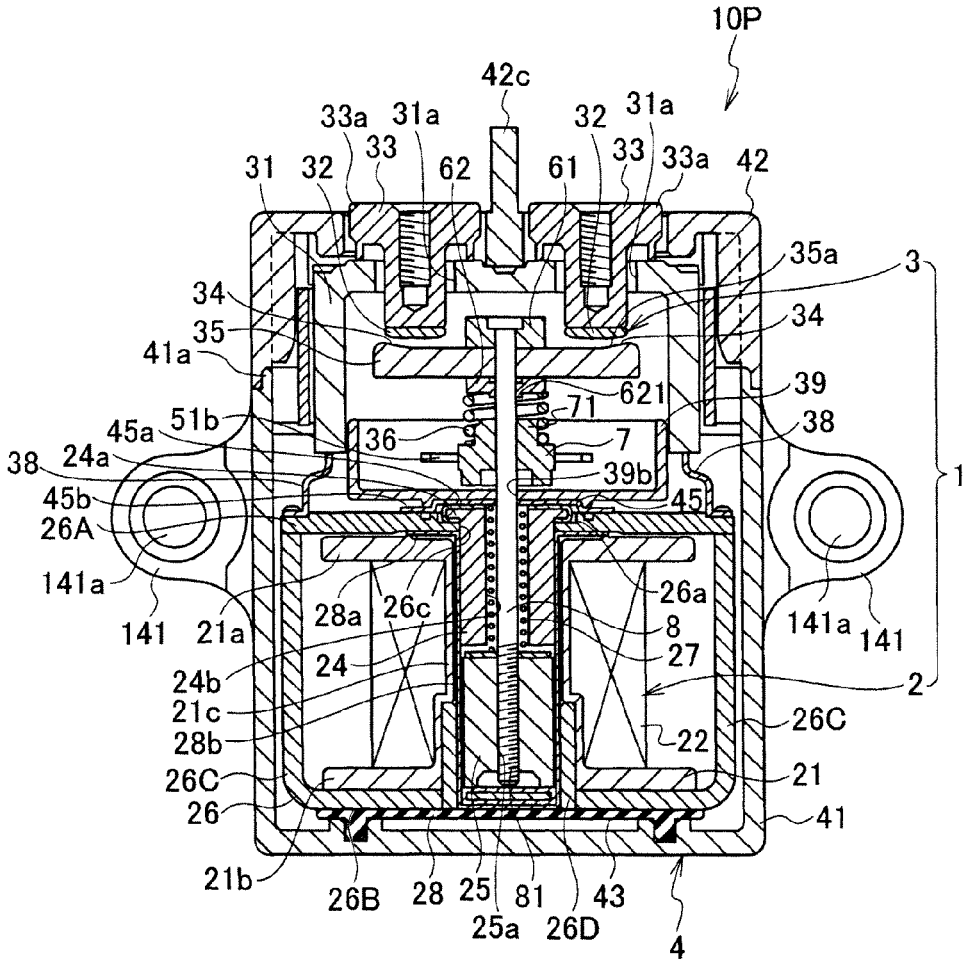
FIG. 20 is a side cross-sectional view showing a contact device according to a third embodiment of the present invention.
Figure 21:
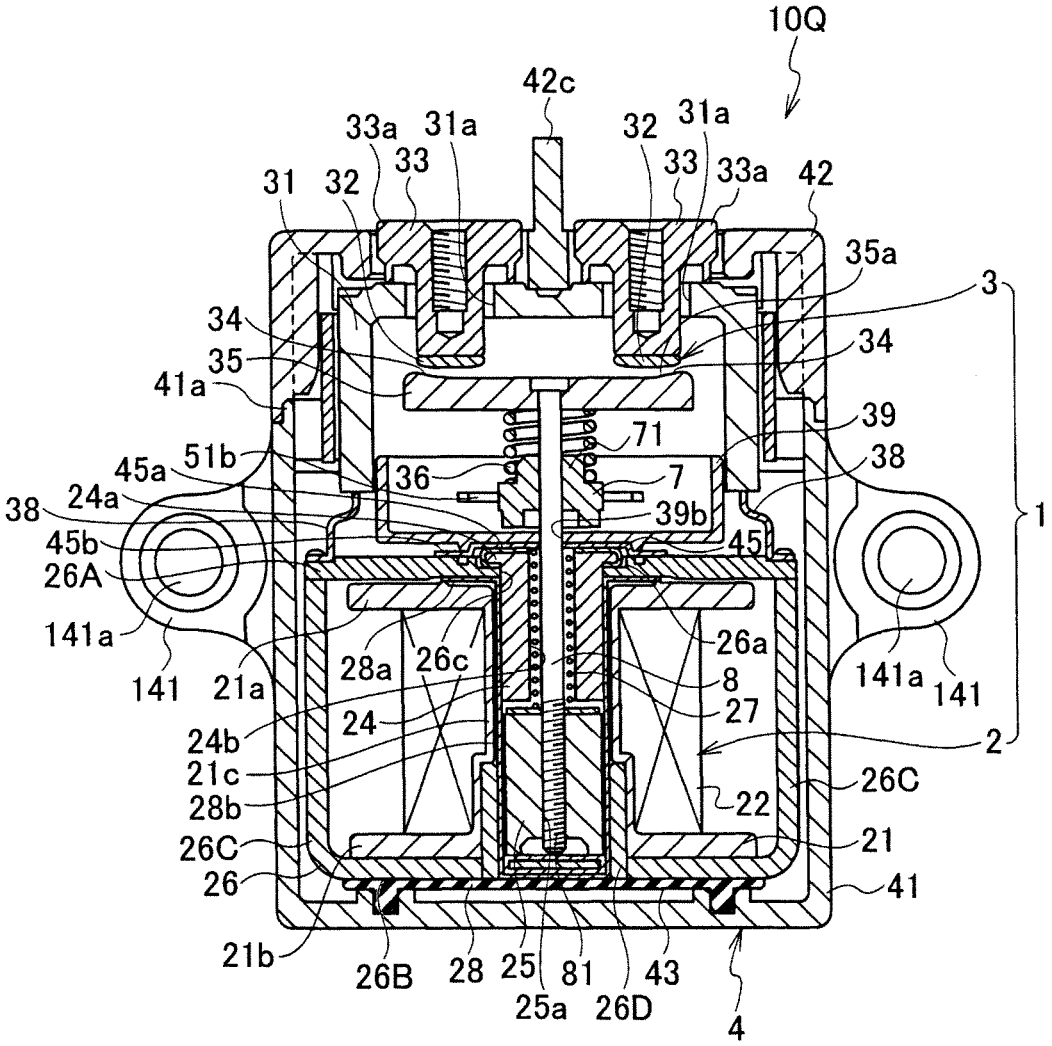
FIG. 21 is a side cross-sectional view showing a contact device according to a fourth embodiment of the present invention.

Moreover, also in this embodiment, the shape of the movable contactor 35 is formed into the shape in which the recessed portion is formed on the center portion of the upper surface, whereby the inclined surfaces 35*a*, which become lower in height toward the insides thereof (center (movable shaft 8) sides in the right-and-left direction when viewed from the above), are formed on the movable contactor 35 (refer to FIG. 20).

Also according to this embodiment described above, similar functions and effects to those of the above-described first embodiment can be exerted.

Note that this embodiment is also applicable to a case where the insulating member 39 is not provided as in the above-described second embodiment.

(Fourth Embodiment)

A contact device 10Q according to this embodiment is different from the contact device 10 of the above-described first embodiment in that the yoke 62 and the adjustment plate 61 are not provided, and that the movable shaft 8 is provided so as to penetrate the movable contactor 35.

That is to say, also in this embodiment, in the at least one fixed terminal 33 among the plurality of fixed terminals 33, the fixed contact 32 and the movable contact 34 are allowed to abut against each other in the region other than the side opposite to the other fixed terminal 33, thus making it possible to suppress the arc from being generated in the inside of the contact.

Then, in both of the pair of fixed terminals 33, that is, in all of the fixed terminals 33, the fixed contacts 32 formed on the individual fixed terminals 33 are allowed to abut against the movable contacts 34 in the regions other than the sides (insides of the contacts) opposite to the fixed terminals 33 on the others' sides.

Moreover, also in this embodiment, the shape of the movable contactor 35 is formed into the shape in which the recessed portion is formed on the center portion of the upper surface, whereby the inclined surfaces 35*a*, which become lower in height toward the insides thereof (center (movable shaft 8) sides in the right-and-left direction when viewed from the above), are formed on the movable contactor 35 (refer to FIG. 20).

Also according to this embodiment described above, similar functions and effects to those of the above-described first embodiment can be exerted.

Note that this embodiment is also applicable to a case where the insulating member 39 is not provided as in the above-described second embodiment.

The description has been made above of the preferred embodiments of the present invention; however, the present invention is not limited to the above-described embodiments, and is modifiable in various ways.

For example, in the above-described respective embodiments, those in each of which the electromagnetic relay is equipped with the contact device are exemplified; however, the contact device is also applicable to a switch, a timer and the like.

Moreover, in the above-described second embodiment, the movable contactors and the fixed terminals (fixed contacts), which are exemplified in the above-described second embodiment and the modification examples thereof, may be arbitrarily selected and combined with one another. Moreover, also in the first, third and fourth embodiments described above, it is possible to arbitrarily select and combine the movable contactors and the fixed terminals (fixed contacts), which are exemplified in the above-described second embodiment and the modification examples thereof, with one another.

Moreover, the present invention can be embodied even in a case where the number of fixed terminals is three or more. For example, in a case where the number of fixed terminals is three, it is possible to define regions of the respective fixed terminals, which are present in an inside of a triangle formed by connecting centers of the individual fixed terminals to one another when viewed from the above, as the insides of the contacts, and to allow the fixed contacts and the movable contacts to abut against each other in regions other than the above (that is, regions located on an outside in the above-described triangle in the respective fixed terminals).

Furthermore, it is also possible to appropriately change specifications (shapes, sizes, layout and the like) of the movable contactor, the fixed terminals and other details.

INDUSTRIAL APPLICABILITY

According to the present invention, there can be obtained the contact device capable of suppressing the arc cutoff performance from being lowered, and obtained the electromagnetic relay equipped with the contact device.

The invention claimed is:

1. A contact device comprising:

a contact block including a plurality of fixed terminals on which fixed contacts are formed, and a movable contactor on which movable contacts contacting and leaving the fixed contacts are formed;

a driving block that drives the movable contactor so that the movable contacts can contact and leave the fixed contacts; and a magnetic field forming unit that is arranged on a periphery of the contact block and forms a magnetic field, wherein:

the plurality of fixed terminals are formed in a pillar shape, respectively, and the fixed contacts are provided on ends of the plurality of fixed terminals, respectively, the fixed contact of at least one fixed terminal among the plurality of fixed terminals includes a first end portion and a second end portion located on an opposite side of the first end portion in a direction in which the first end portion is opposed to the fixed contact of another fixed terminal, the first end portion being closer to the fixed contact of the another fixed terminal than the second end portion, a shortest distance between the second end portion and a portion at which the fixed contact of the at least one fixed terminal abuts against the movable contact is smaller than a shortest distance between the first end portion and the portion at which the fixed contact of the at least one fixed terminal abuts against the movable contact, and the magnetic field forming unit includes a pair of permanent magnets arranged opposite to each other through the contact block in a direction perpendicular to a contacting/leaving direction of the movable contacts and the fixed contacts.

2. The contact device according to claim 1, wherein the fixed contact of the one fixed terminal is allowed to abut against the movable contact by forming a step difference portion on at least one side of a fixed terminal side and a movable contactor side.

3. The contact device according to claim 2, wherein the step difference portion is formed on the movable contactor side.

4. The contact device according to claim 3, wherein the movable contactor is driven by a driving shaft of the driving block, and the step difference portion is formed to have a circular arc shape taking the driving shaft of the movable contactor as a substantial center when viewed from the above.

5. The contact device according to claim 2, wherein the step difference portion is formed on the fixed contact side.

6. The contact device according to claim 5, wherein the step difference portion is formed over an entire circumference of the fixed terminal side.

7. An electromagnetic relay, wherein the electromagnetic relay is equipped with the contact device according to claim 1.

8. The contact device according to claim 1, wherein polarities of surfaces of the pair of permanent magnets are the same, where the surfaces are opposite to each other.

9. The contact device according to claim 1, wherein a gap between the second end portion and the movable contactor opposed to the second end portion in a movement direction of the movable contactor is smaller than a gap between the first end portion and the movable contactor opposed to the first end portion in the movement direction of the movable contactor.

10. A contact device comprising:

a contact block including a plurality of fixed terminals on which fixed contacts are formed, and a movable contactor on which movable contacts contacting and leaving the fixed contacts are formed;

a driving block that drives the movable contactor so that the movable contacts can contact and leave the fixed contacts; and a magnetic field forming unit that is arranged on a periphery of the contact block and forms a magnetic field, wherein:

the plurality of fixed terminals are formed in a pillar shape, respectively, and the fixed contacts are provided on ends of the plurality of fixed terminals, respectively, the fixed contact of at least one fixed terminal among the plurality of fixed terminals includes a first end portion a center portion and a second end portion located on an opposite side of the first end portion in a direction in which the first end portion is opposed to the fixed contact of another fixed terminal, the first end portion being closer to the fixed contact of the another fixed terminal than the second end portion, and the center portion being located in a middle between the first end portion and the second end portion, a non-contact region in which the fixed contact of the at least one fixed terminal does not abut against the movable contact is provided between the center portion and the first end portion, a contact region in which the fixed contact of the at least one fixed terminal abuts against the movable contact is provided between the center portion and the second end portion, an area of the contact region is larger than an area of a region in which the fixed contact of the at least one fixed terminal abuts against the movable contact between the center portion and the first end portion, and the magnetic field forming unit includes a pair of permanent magnets arranged opposite to each other through the contact block in a direction perpendicular to a contacting/leaving direction of the movable contacts and the fixed contacts.

11. A contact device comprising:

a contact block including a plurality of fixed terminals on which fixed contacts are formed, and a movable contactor on which movable contacts contacting and leaving the fixed contacts are formed;

a driving block that drives the movable contactor so that the movable contacts can contact and leave the fixed contacts; and a magnetic field forming unit that is arranged on a periphery of the contact block and forms a magnetic field, wherein:

the plurality of fixed terminals are formed in a pillar shape, respectively, and the fixed contacts are provided on ends of the plurality of fixed terminals, respectively, the fixed contact of at least one fixed terminal among the plurality of fixed terminals includes a first end portion a center portion and a second end portion located on an opposite side of the first end portion in a direction in which the first end portion is opposed to the fixed contact of another fixed terminal, the first end portion being closer to the fixed contact of the another fixed terminal than the second end portion, and the center portion being located in a middle between the first end portion and the second end portion, the fixed contact of the at least one fixed terminal abuts against the movable contact between the center portion and the second end portion, the fixed contact of the at least one fixed terminal does not abut against the movable contact between the center portion and the first end portion, and the magnetic field forming unit includes a pair of permanent magnets arranged opposite to each other through the contact block in a direction perpendicular to a contacting/leaving direction of the movable contacts and the fixed contacts.

* * * * *